US007834290B2

(12) United States Patent
Birner et al.

(10) Patent No.: US 7,834,290 B2
(45) Date of Patent: Nov. 16, 2010

(54) PROTECTION SWITCH

(75) Inventors: Markus Birner, Zirndorf (DE); Klaus Loos, Winkelhaid (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 12/333,558

(22) Filed: Dec. 12, 2008

(65) Prior Publication Data

US 2009/0145882 A1 Jun. 11, 2009

Related U.S. Application Data

(63) Continuation of application No. PCT/EP2006/009295, filed on Sep. 25, 2006.

(30) Foreign Application Priority Data

Jun. 12, 2006 (DE) ..... 10 2006 027 140

(51) Int. Cl.
*H01H 33/20* (2006.01)

(52) U.S. Cl. ..... 218/36; 218/40; 218/148; 335/10; 335/201

(58) Field of Classification Search ..... 218/34–40, 218/148–157; 335/201–203, 16, 17, 147, 335/195, 6–10, 167–176
See application file for complete search history.

(56) References Cited

U.S. PATENT DOCUMENTS 2,468,422 A 4/1949 Wood
4,436,087 A 3/1984 Ouchi
4,849,590 A * 7/1989 Becker et al. ..... 218/33
5,103,198 A 4/1992 Morel et al.
5,298,874 A 3/1994 Morel et al.

FOREIGN PATENT DOCUMENTS

| | | | |
|---|---|---|---|
| EP | 0251160 | A2 | 1/1988 |
| EP | 0538149 | A1 | 4/1993 |
| FR | 2661776 | A1 | 11/1991 |
| JP | 54057173 | A | 5/1979 |
| JP | 54095368 | A | 7/1979 |
| JP | 56143633 | A | 11/1981 |
| WO | 9512888 | A1 | 5/1995 |

OTHER PUBLICATIONS

International Search report dated Apr. 12, 2007.

* cited by examiner

*Primary Examiner*—Renee S Luebke
*Assistant Examiner*—Marina Fishman
(74) *Attorney, Agent, or Firm*—Laurence A. Greenberg; Werner H. Stemer; Ralph E. Locher

(57) ABSTRACT

A protection switch, particularly for rapid quenching of electrical arcing, includes at least one single-pole protection switch module having a housing, a movable contact mounted on a switching arm for pivoting against a fixed contact between a closed position and an open position and a quenching device for quenching electrical arcing of the switch. The quenching device includes a quenching chamber with an inlet and an outlet for the arc. A first running rail connects the fixed contact with a first side wall of the quenching chamber and a second running rail connects a stopping surface, against which the movable contact abuts in the open position of the switching arm, to a second side wall of the quenching chamber. A separation strip extends substantially from side wall to side wall at the outlet of the quenching chamber.

11 Claims, 18 Drawing Sheets

PROTECTION SWITCH

CROSS-REFERENCE TO RELATED APPLICATION

This is a continuing application, under 35 U.S.C. §120, of copending International Application No. PCT/EP2006/009295, filed Sep. 25, 2006, which designated the United States; this application also claims the priority, under 35 U.S.C. §119, of German Patent Application DE 10 2006 027 140.8, filed Jun. 12, 2006; the prior applications are herewith incorporated by reference in their entirety.

BACKGROUND OF THE INVENTION

Field of the Invention

The invention relates to a protection switch having at least one single-pole protection switch module. The at least one protection switch module includes a housing, a switching arm carrying a movable contact being pivotably movable against a fixed contact between a closed position and an open position, a manual operating mechanism for manually adjusting the switching arm between the closed position and the open position, and a tripping mechanism for automatically resetting the switching arm into the open position when a tripping condition arises.

Such a protection switch is known, for example, from French Patent Application FR 2 661 776 A1, corresponding to U.S. Pat. No. 5,103,198. The tripping mechanism of the known protection switch includes an electromagnetic trip device and a bimetallic trip device. The electromagnetic trip device detects a short circuit and the bimetallic trip device detects an overload condition, as tripping conditions. When the respective tripping condition occurs, the corresponding trip device acts on a tripping arm which, in turn, unlatches the switching arm and thus triggers the resetting of the switching arm into the open position.

A protection switch of the above-mentioned type should generally produce the fastest possible separation of the electrical connection formed between the moving contact and the fixed contact when the tripping condition occurs, in order to effectively protect a circuit following the protection switch against a short circuit and/or overload damage. In this context, in particular, a switching arc which unavoidably occurs between the moving contact and the fixed contact during the switching process should be quenched as rapidly as possible in order to stop the current flow and prevent the contact material from burning off, if possible. The rapid quenching of the switching arc is of particular importance especially in the case of a short circuit and overload especially since in those cases, the switching arc develops a particularly strong destructive effect due to the high current flow. At the same time, however, a protection switch should have the simplest possible structure, and should be inexpensive to produce, for manufacturing reasons.

Protection switches of the above-mentioned type are produced both in single-pole and multi-pole constructions. In the sense of cost-saving production, multi-pole protection switches are usually implemented in modular fashion in each case from single-pole protection switch modules, with the protection switch modules being abutted end to end for implementing a multi-pole protection switch. Such a modular protection switch is known, for example, from European Patent Application EP 0 538 149 A1, corresponding to U.S. Pat. No. 5,298,874.

FIELD OF THE INVENTION

It is accordingly an object of the invention to provide a protection switch, which overcomes the hereinafore-mentioned disadvantages of the heretofore-known devices of this general type and which is particularly suitable with respect to the background described above, particularly with regard to a rapid quenching of switching arcs.

With the foregoing and other objects in view there is provided, in accordance with the invention, a protection switch, comprising at least one single-pole protection switch module including a housing, a switching arm, a fixed contact, a moving contact carried by the switching arm and being pivotably movable against the fixed contact between a closed position and an open position, a manual operating mechanism for manually adjusting the switching arm between the closed position and the open position, a tripping mechanism for automatically resetting the switching arm into the open position upon occurrence of a tripping condition, and a quenching device for quenching a switching arc. The quenching device has a quenching chamber with first and second side walls and an inlet and an outlet for the arc. A first running rail connects the fixed contact with the first side wall of the quenching chamber. A stopping surface is provided, at which the moving contact rests in the open position of the switching arm. A second running rail connects the stopping surface with the second side wall of the quenching chamber. A separation strip extends substantially from side wall to side wall of the quenching chamber, is molded onto the outlet of the quenching chamber and dams up the outlet of the quenching chamber by about 35% to 50% as compared with the inlet.

The protection switch according to the invention is thus equipped with a quenching device for the particularly rapid quenching of a switching arc. The quenching device includes a quenching chamber, which has an inlet and an outlet for the arc and side walls extending, for instance, perpendicularly thereto. The quenching device also includes two running rails, which are used for guiding the switching arc from the contacts into the switching chamber. In this context, a first running rail connects the fixed contact with a first side wall of the quenching chamber. The second running rail connects a stopping surface at which the moving contact rests in the open position of the switching arm, with the second side wall of the quenching chamber.

According to the invention, a separating strip which substantially extends from side wall to side wall of the quenching chamber and, in doing so, separates the outlet of the quenching chamber into two approximately equal partial-areas, is molded onto the outlet of the quenching chamber. In this invention, the separating strip is aligned approximately perpendicularly to the quenching plates of a stack of quenching plates of the quenching chamber and protrudes over the outlet of the quenching chamber. In this way, the separating strip divides the gas stream leaving the quenching chamber into two partial-streams and in this way reduces the risk that the arc punches through, i.e. arcs back after passing through the quenching chamber. The separating strip extending from side wall to side wall of the quenching chamber according to the invention thus extends particularly in the longitudinal direction over the quenching chamber cross section. This enables the quenching chamber to be constructed especially flatly with sufficiently good quenching characteristic. This, in turn, provides for an especially flat protection switch construction. Thus, a width of about 12 mm can be achieved easily for the protection switch according to the invention, whereas comparable protection switches usually have previously had a width of about 18 mm.

The second running rail is in contact with a current supply through which the second running rail is short circuited to the moving contact so that the moving contact and the second running rail are always at the same electrical potential. In this configuration, the second running rail is advantageously in contact with the current supply in such a manner that the contact point between the running rail and the current supply, as seen from the moving contact in the direction of the contact lever, is located behind the stopping surface of the switching arm, or that, in other words, the stopping surface of the switching arm at the second running rail is located between the contact point of this running rail with the current supply and the quenching chamber. Due to this structural configuration it can be achieved that the geometric characteristic of the current conduction within the protection switch is retained even at the transition of the arc from the contacts to the adjoining running rails (which is also called commutation). In particular, an induction effect caused by the current path, through the use of which the arc is driven in the direction of the quenching chamber due to the electrodynamic interaction, is maintained with respect to its sign in the commutation process so that the course of the arc is not braked during the commutation.

In a structurally simple and inexpensive embodiment which, at the same time, is advantageous with regard to its mechanical stability and symmetric current conduction, the second running rail and the current supply are formed from the same metal strip, with the running rail being cut out of this metal strip in the center in the manner of a lug and being bent out.

In a preferred embodiment, the quenching device is optimized to the extent that a switching arc is rapidly and effectively "sucked into" the quenching chamber without passing through the quenching chamber and arcing back at the outlet or bouncing off at the quenching chamber and arcing back before its inlet. This optimization is achieved, on one hand, by a balanced damming of the outlet of the quenching chamber opposite the inlet, which is suitably selected within a range of about 35% to 50%, preferably about 40% to 45% and especially as about 42%. In this context, damming is the ratio of the free outlet area with respect to the free inlet area. Suitable damming is achieved, in particular, by correspondingly dimensioning the separating strip.

In addition to the separating strip, at least one guide plate is preferably disposed at the output of the quenching chamber, through the use of which the gas stream leaving the quenching chamber is divided and deflected in the direction of a housing opening. It has been found that the guide plate or the guide plates significantly improve the pressure and flow conditions at the output of the quenching chamber and thus further reduce the risk of back arcing of the arc before the respective outlet or inlet of the quenching chamber. Preferably, several guide plates are provided over the areas of the outlet (i.e. from side wall to side wall) and, if necessary, on both sides of the separating strip. The guide plate or each guide plate is formed, in particular, of plastic and is molded onto the inside of the housing in a variant of the invention which is advantageous with respect to production.

In a further advantageous variant of the invention, an arc running space formed between the running rails is limited by a cover plate, at least towards one housing end face.

The cover plate or each cover plate, in turn, is disposed at a distance from the housing so that a duct which is approximately run in parallel with the arc running space is formed between a cover plate and the housing. This embodiment of the invention is based on the finding that the arc, on its way along the running rails, due to sudden heating of the air, pushes along a pressure wave in front of it which can impede the arc from running into the quenching chamber whereas, on the other hand, an underpressure is produced in the area of the contacts which may suck the arc back into the contact area in an undesirable manner. This problem is prevented by the duct running on the other side of the cover plate or each cover plate, especially since due to this duct, a pressure equalization can take place during the running of the arc. In order to promote this pressure equalization, the cover plate or each cover plate is preferably constructed in such a manner that the pressure compensating duct limited by this cover plate is open, on one hand, towards the inlet of the quenching chamber and, on the other hand, towards an end of the arc running space facing the contacts.

In a further structural simplification of the protection switch, the first running rail is preferably constructed integrally or in one piece with the magnetic yoke of the short-circuit trip device, i.e. as a part of the latter or mechanically integrally coherent or in one piece with the latter. In order to obtain the geometric characteristic of the current path within the protection switch during the commutation of the arc onto the running rails in this configuration, the magnetic yoke is suitably interrupted by a gap in an area adjoining the outlet of the quenching chamber.

A further structural simplification of the protection switch is preferably achieved by the fact that the second running rail or the current supply connected to it is used as a carrier for the bimetallic strip of the overload trip device.

The switching arm is preferably spring-loaded in the direction of the open position and latchable with a catch of the manual operating mechanism in such a manner that the switching arm can be moved into the closed position against the spring pressure and is held there due to the latching through the use of the manual operating mechanism. In a suitable embodiment, the tripping mechanism has a trip slider which can be moved by a trip device from a ready position in the direction of a tripped position, i.e. a position assumed by the trip slider in the tripped state.

In order to provide for a particularly fast tripping process, i.e. a particularly fast electrical separation of the moving contact and of the fixed contact, the trip slider is preferably constructed in such a manner that, when advancing, it unlatches the switching arm, on one hand, from the catch so that the switching arm is automatically moved in the direction of the open position due to the spring pressure but that the trip slider, on the other hand, also loads the switching arm in the direction of the open position in order to accelerate the resetting of the switching arm into the open position.

In a structurally advantageous embodiment, the trip slider preferably has an unlatching contour for unlatching the switching arm, which moves the catch away from an attack position with the switching arm so that the switching arm is released. In order to carry out the loading, i.e. the "pushing" of the switching arm in the direction of the open position, the trip slider preferably has a corresponding stop.

In the sense of a particularly fast tripping process, the trip slider is suitably constructed in such a manner that, with progressive advance as part of the tripping process, it realizes its two functions, namely the unlatching of the switching arm from the catch and the "pushing" of the switching arm, approximately simultaneously, with the switching arm first suitably being unlatched and the trip slider immediately thereafter stopping against the switching arm. Such a time period is deemed negligible in the context of the application. In this embodiment or also independently thereof, the protection switch is disposed in such a manner that the trip slider is accelerated during the tripping process before it stops against the switching arm and therefore impinges on the latter with an initial speed different from zero in order to overcome the mechanical inertia of the switching arm as rapidly as possible, while making use of the kinetic energy of the trip slider.

In a structurally simple and suitable embodiment of the invention, the switching arm is constructed of two members and includes a contact lever, which carries the actual moving contact, and a latch lever, which can be latched with the manual operating mechanism. The latch lever is pivotably movably supported on the housing. The contact lever is pivoted on the latch lever through the use of a rotating hinge.

The contact lever is preferably elastically pretensioned with respect to the latch lever in the direction of the closed position so that the moving contact rests under pretension against the fixed contact when the switching arm is located in its closed position. The flexibility of the switching arm and the pretension have the result that a secure rest of the contacts is always guaranteed even with increasing wear of the contact material on the moving contact and on the fixed contact, which is unavoidable in the course of the life of the protection switch. In an embodiment of the invention which is advantageous from the point of view of production, a spring, particularly a tension spring, is provided which both pretensions the contact lever in the direction of the closed position and the switching arm overall in the direction of the open position. This dual function of the spring is achieved by the point of attack of the spring, as seen from the moving contact, being disposed behind the rotating hinge at the contact lever.

In a particularly preferred embodiment of the invention, the trip slider and the switching arm are constructed in such a manner that the trip slider, when it stops against the switching arm, at the same time rotationally fixes the contact lever in its position with respect to the housing. As a result, a situation is avoided in which the switching arm first relaxes (with relative rotation of the contact lever with respect to the latch lever) at the beginning of the resetting phase. This is because this would initially hold the moving contact at the fixed contact and delay the switching process. Instead, in the embodiment of the invention described above, the moving contact, due to the rotational fixing, is lifted away from the fixed contact immediately when the trip slider stops against the switching arm. Due to this embodiment, the so-called response time of the protection switch during short-circuit tripping, i.e. the time between the start of the short-circuit current and the lifting away of the contacts, can be significantly reduced. In particular, a response time of up to approximately 0.5 msec can be achieved. During this process, the short circuit current is effectively already limited in the rising phase.

As an alternative or in addition, the trip slider is preferably disposed with respect to the switching arm in such a manner that it stops against the switching arm, which is located in its closed position, in the area of the rotating hinge. This embodiment is advantageous, on one hand, in the respect that when the tripping slider is stopped, no torque (relative to the latch lever) is exerted on the contact lever so that the kinetic energy of the trip slider is completely wholly used in the acceleration of the switching arm. On the other hand, this embodiment is based on the finding that the position of the rotating hinge, in contrast to the orientation of the contact lever in the closed position, is independent of the wear of the contact material. By selecting the rotating hinge as the starting point for the trip slider, a switching behavior is thus achieved which is constant over the life of the protection switch.

In a preferred variant of the invention, the trip slider is only pushed ahead by the trip device during an initial phase of the tripping process. In contrast, in an adjoining tripping phase, the trip slider is carried along by the switching arm returning into its open position until the trip position is reached. This embodiment takes into consideration that only a comparatively short travel can be achieved by conventional trip devices. In contrast, due to the trip slider being carried along by the switching arm, the distance of advance of the trip slider between the ready position and the trip position is extended. The greater distance of advance of the trip slider is particularly advantageous in this context in order to provide a switching impulse with the trip slider for the coupled tripping of adjoining protection switch modules.

The trip slider is suitably used at the same time for implementing a free tripping of the protection switch. The term free tripping is understood to be a mechanical forced decoupling of the switching arm by the manual operating mechanism which has the effect that the switching arm can be tripped even when the manual operating mechanism is kept in a position corresponding to the closed position of the switching arm, and that the switching arm cannot be adjusted into the closed position through the use of the manual operating mechanism when and as long as the tripping condition exists.

For this purpose, the trip slider is provided, as a component part of the unlatching contour, with a slide-up slope on which the catch of the manual operating mechanism is carried and on which the catch is unlatched from the switching arm when the advance of the trip lever is blocked in the direction of the ready position. The slide-up slope is advantageously also used as a force deflector in order to advance the trip slider, during the manual adjustment of the switching arm into its closed position, from the trip position in the direction of the ready position.

In a suitable embodiment, the manual operating mechanism includes a tilting lever on which a coupling rod is eccentrically supported. The coupling rod carries the catch at one free end. The tilting lever is suitably pretensioned, particularly by a torsion spring, in the direction of a first tilted position corresponding to the open position of the switching arm, so that the tilting lever, in the unloaded state, always returns by itself into this first tilted position. In contrast, in a second tilted position corresponding to the closed position of the switching arm, the tilting lever is preferably stopped by the catch being latched to the switching arm located in the closed position. The switching arm and the manual operating device are suitably matched to one another in such a manner that when the switching arm returns into the open position and the tilting lever returns into the first tilted position, the catch automatically latches to the switching arm so that the switching arm can immediately be adjusted again without further ado through the use of the manual operating mechanism. In order to ensure secure latching of the coupling rod to the switching arm, the coupling rod is suitably pressed against the switching arm by a spring in the first tilted position. In a structurally particularly simple variant, this spring is formed, in particular, by a spring lug injection molded in one piece on the tilting lever.

The protection switch advantageously includes a short-circuit trip device which is disposed for operating the trip slider as a tripping condition in the case of a short circuit. The short circuit trip device includes a magnetic coil, a magnetic yoke and a magnetic armature which is connected to a plunger provided for advancing the trip slider.

In a short-circuit trip device which is particularly compact with regard to its mounting height and therefore particularly suitable for implementing a flat protection switch module, the magnetic coil is constructed with a substantially rectangular coil cross section.

In order to provide such a compact magnetic coil with a through opening for the plunger in a simple manner with regard to production, a magnetic core of the coil is suitably formed from two adjoining core disks of ferromagnetic material. In this configuration, each of these core disks is provided with a longitudinal slot. The longitudinal slots of the adjoining core disks complement one another to form a through opening which is sufficiently large for accommodating the plunger. This division of the magnetic core into two can be advantageously used in any protection switches and any coil cross section with a magnetic short-circuit trip device and is considered to be inventive even by itself.

In addition or as an alternative to the short-circuit trip device, the protection switch advantageously includes an overload trip device. The overload trip device is substantially formed by a bimetallic strip which heats up due to the current flow through the protection switch and in doing so, is deformed in such a manner that it operates the trip slider in the overload case.

In this context, in a preferred embodiment of the invention, a projection on the trip slider is provided as a thrust bearing or straining point for the bimetallic strip. This straining point is formed particularly by a cam which can be rotated with respect to the trip slider. This cam is used for adjusting an overload tripping threshold for the overload trip device by varying the distance formed between the straining point or cam, respectively, and the bimetallic strip (particularly in the ready position of the trip slider) by rotating the cam with respect to the trip slider. In particular, the cam can be locked in several defined positions of rotation at the trip slider. In this configuration, the trip slider, in a structurally simple and suitable embodiment, is particularly provided with a holder for supporting the cam which has a notch in the manner of a toothed wheel that, in turn, is engaged by a projection (or arresting tooth) of the cam. The adjusting capability for the overload trip device, described above, can also be advantageously used not only in the protection switch described above but generally with a protection switch with a bimetallic trip device.

In a further advantageous embodiment of the protection switch, the latter includes a signal relay which can be operated through the use of the trip slider in order to indicate its position and thus the switching state of the protection switch.

In order to achieve a high degree of prefabrication for protection switches with different numbers of poles, several examples of the single-pole protection switch module described previously can be suitably combined to form a multi-pole protection switch configuration by fitting these protection switch modules together in each case at their end faces. In this configuration, the protection switch is constructed in a suitable embodiment in such a manner that the protection switch modules joined together form a mechanically coherent unit, on one hand, wherein, at the same time, the manual operating mechanism of all of the protection switch modules is coupled so that the protection switch modules can only be switched jointly. At the same time, it is provided that the tripping mechanism of all of the protection switch modules is coupled so that tripping each one of the protection switch modules also trips all other protection switch modules.

In a structurally simple variant of the protection switch, a coupling piece is provided for this purpose which serves both for mechanically fixing the protection switch modules to one another and effecting a coupling of the manual operating mechanism and of the tripping mechanism of the adjoining protection switch modules. In a particularly simple embodiment, this coupling piece is constructed of one piece, particularly as an inexpensive molded plastic part.

In order to at least partially cover the end faces of a single-pole or multi-pole protection switch lying on the outside, a dummy lid is also optionally provided which can be modularly placed onto this outside housing end face instead of the coupling piece in the manner of a building block system.

In order to connect an electrical conductor, the protection switch module or each protection switch module has a supply connection which is electrically connected to the fixed contact in the interior of the module. The supply connection of each protection switch module preferably has a coupling contact, through the use of which several adjoining protection switch modules of a multi-pole protection switch configuration can be connected in parallel through the use of a current rail. This dispenses with the requirement of having to separately wire each protection switch module at the input end. Instead, all protection switch modules are supplied through a common current feed line in a manner of a current distributor.

In a further advantageous embodiment of the protection switch, each protection switch module also has two signal connections for connecting conductors which are electrically connected to the signal relay inside the module. A coupling contact through which the signal connections of different protection switch modules can be electrically interconnected is also suitably connected in each case in parallel with these signal connections.

The coupling contact or each coupling contact in this configuration is disposed in a housing slot which spans the entire housing width so that a current rail constructed as a profile component can be inserted into the housing slots for bridging the coupling contacts of adjoining protection switch modules. In order to improve the operational reliability of the protection switch, the housing slot or each housing slot in this configuration is dimensioned with regard to its dimensioning, i.e. its opening side and depth, in such a manner that the coupling contact is accommodated to the housing in a finger-proof manner.

In order to prevent accidental contact with the end of such a current rail at an external end face of a protection switch module, the protection switch preferably also includes a closing strip of insulating material which can be inserted flush with each housing end face into the housing slot and, in the inserted state, closes the housing slot off towards this end face.

In a preferred development of this embodiment, the housing slot or each housing slot has a guide strip at each housing end face which preferably runs around at least a part of the end face edge of the housing slot but at least protrudes into the space left by the housing slot from both slot walls. On one hand, this guide strip, by form-locking engagement in a corresponding guide notch of the closing strip, is used for fixing the latter at the housing in the inserted state. A form-locking connection is one which connects two elements together due to the shape of the elements themselves, as opposed to a force-locking connection, which locks the elements together by force external to the elements. An advantageous secondary function is fulfilled by the guide strip when no closing strip is inserted into the housing slot, in that the guide strip reduces the slot width at the housing edge at the end face and, as a result, the risk of accidental contact with the coupling contacts accommodated in the housing slot is further reduced.

Other features which are considered as characteristic for the invention are set forth in the appended claims.

Although the invention is illustrated and described herein as embodied in a protection switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 19 to 21 are perspective views of a five-pole embodiment of the protection switch, in which FIG. 19 is exploded and five protection switch modules are interconnected with one another in the manner of a current distributor.

DETAILED DESCRIPTION OF THE INVENTION

Figure 1:
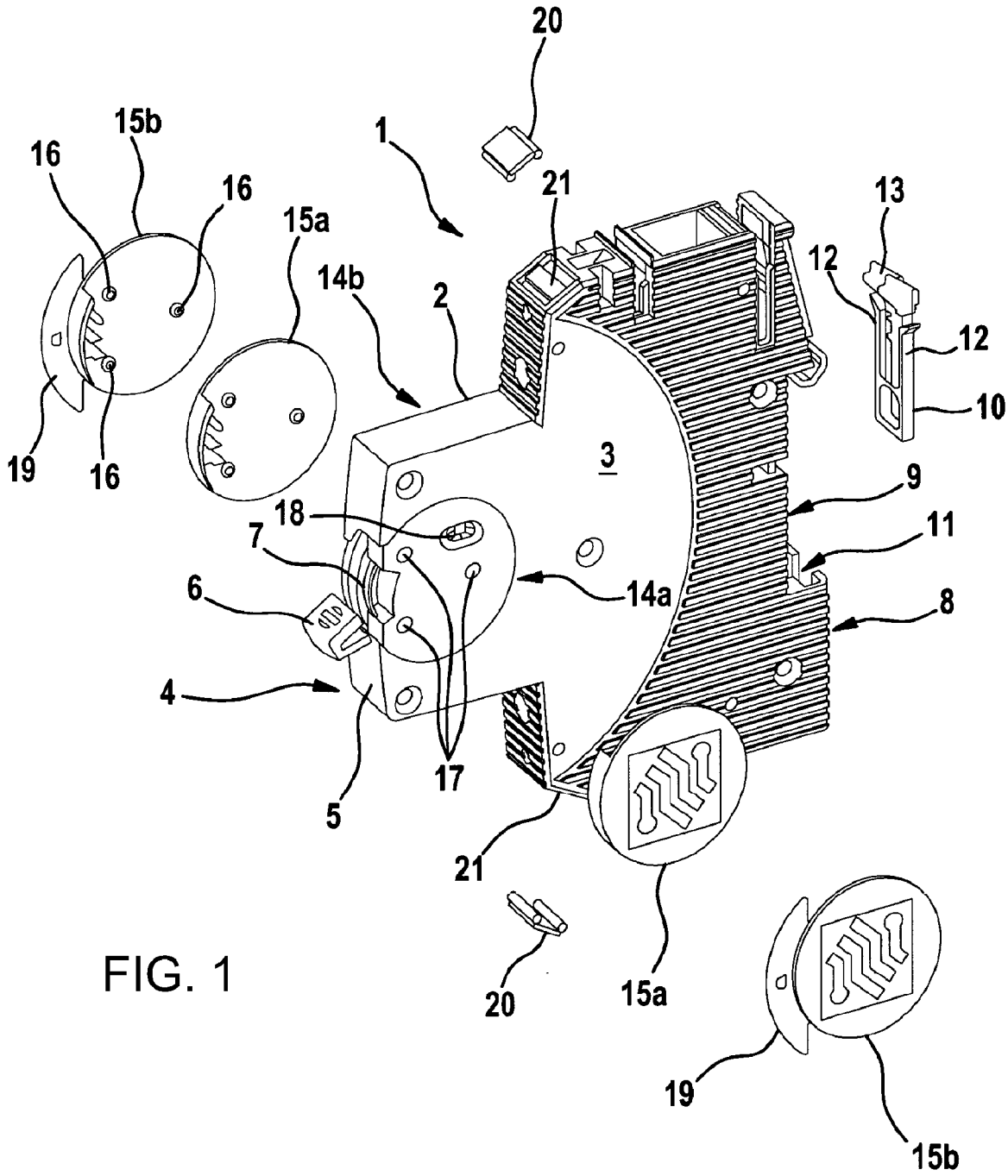
FIG. 1 is a diagrammatic, exploded, perspective view of a single-pole protection switch with a protection switch module and exchangeable dummy lids for partially covering end faces of a protection switch module.

Referring now in detail to the figures of the drawings, in which parts and magnitudes corresponding to one another are always provided with the same reference symbols in all of the figures, and first, particularly, to FIG. 1 thereof, there is seen an illustrative embodiment of the invention which relates to a protection switch 1 of modular construction in a manner of a building block system, that can be implemented in a single-pole or multi-pole construction by combining a number of components. The core component of this building block system is a protection switch module 2 which, seen by itself, already forms a completely operable single-pole protection switch.

Single-pole constructions of the protection switch 1 as shown, in particular, in FIGS. 1 to 6, are correspondingly formed substantially by a single protection switch module 2. Multi-pole constructions of the protection switch 1 as shown in FIGS. 17 to 21 are formed by joining together a number of protection switch modules 2 corresponding to the number of poles of the protection switch 1.

According to FIG. 1, the protection switch module 2, initially shown in a view from the outside, includes a housing 3 of insulating material. The protection switch module 2 is constructed in the manner of a modular device. The housing 3 correspondingly exhibits the construction characteristic of such devices stepped down symmetrically towards a front face 4. A handle 6 of a pivoted lever 7 protrudes from the housing at a protruding center part 5 of the front face 4, for actuation of the protection switch module 2. The protection switch module 2 is provided with a receptacle typical of modular devices at a rear face 8 opposite the front face 4, for locking the protection switch module 2 onto a mounting rail, particularly a top hat rail. In order to fix the protection switch module 2 on the mounting rail, a locking slider 10 is provided which is carried displaceably in a guide 11 of the housing 3. The locking slider 10 is provided with spring arms 12 molded onto its sides which interact with a simplified sawtooth-like contour of the guide 11 in such a manner that the locking slider 10, in the assembled state, is captively fixed in the guide and can be displaced bistably between a locked position in which a locking nose 13 of the locking slider 10 protrudes into the receptacle 9 and a release position in which the locking nose 13 is pulled back from the receptacle 9. Due to its bistable guidance, the locking slider 10 remains in the release position when it is manually pulled back from the locked position by a user, particularly for disassembling the protection switch module 2, so that the protection switch module 2 can be simply lifted from the mounting rail. In this configuration, the bistable locking of the locking slider 10 in the release position is particularly advantageous for being able to remove several protection switch modules 2, hanging together or wired together, jointly from a mounting rail without having to actuate the locking sliders 10 of each protection switch module 2 simultaneously. On the other hand, the locking slider 10 is elastically guided in the lock position by interaction of the spring arms 12 with the sawtooth-like contour of the guide 11 so that the protection switch module 2 can be snapped onto the mounting rail by simply pushing it onto the latter.

In the single-pole embodiment of the protection switch 1, a dummy lid 15*a* or 15*b* which closes the housing 3 towards the outside in the area of the pivoted lever 7 is snapped onto each end face 14*a*, 14*b* of the housing 3. Each dummy lid 15*a*, 15*b* is snapped with three holding projections 16 in the corresponding receptacles 17 of the housing 3. As can be seen from FIGS. 2 and 3, each dummy lid 15*a*, 15*b*, in its assembled position, covers particularly a contact opening 18 provided in each end face 14*a*, 14*b* of the housing 3. The protection switch module 2 (as will be explained in greater detail in the text which follows) can be coupled to adjacent protection switch modules 2 in multi-pole embodiments of the protection switch 1 through the contact opening 18.

Figure 2:
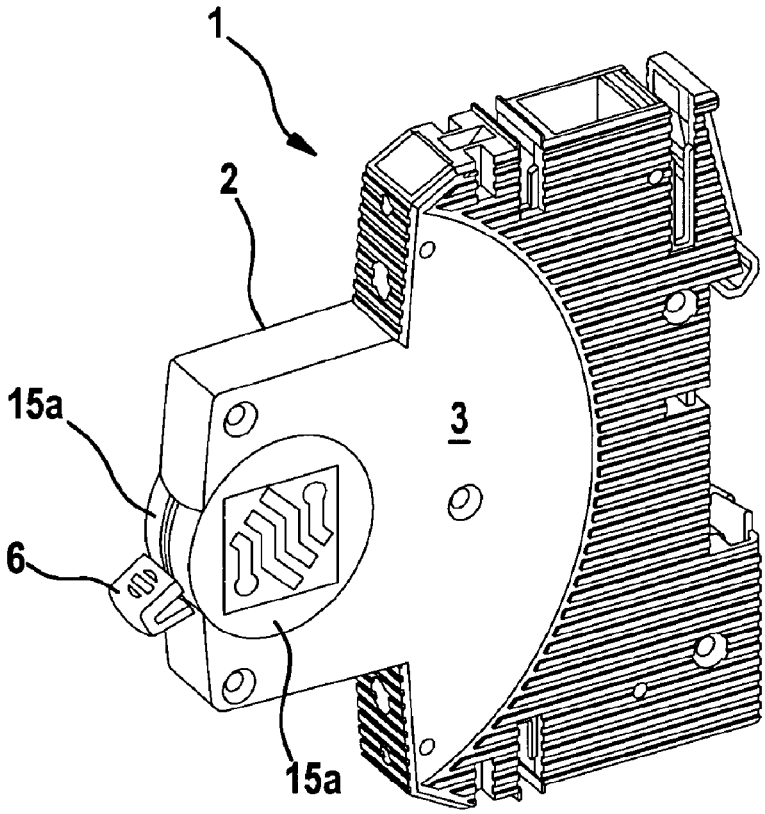
FIG. 2 is a perspective view of the protection switch according to FIG. 1 with a first type of dummy lids.
Figure 3:
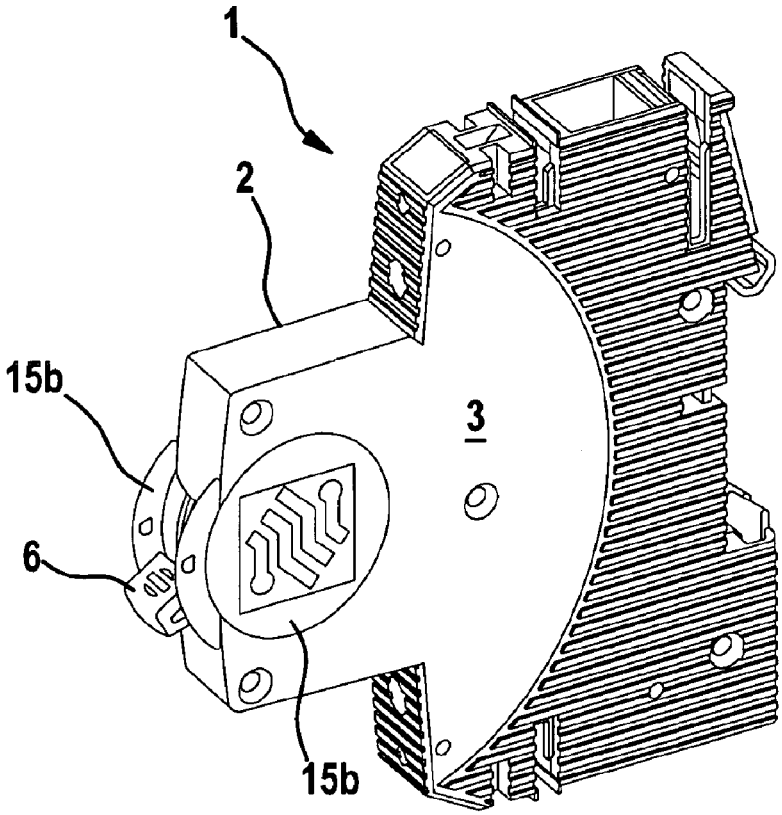
FIG. 3 is a perspective view in a representation according to FIG. 2, in which the protection switch has a second type of dummy lids.

FIG. 1 shows two types of dummy lids 15*a* and 15*b*, respectively, which can be snapped onto the housing 3 alternatively to one another. The dummy lids 15*b* differ from the dummy lids 15*a* in that they are additionally provided with a rail section 19 which, in the assembled state (compare FIG. 3), flanks the pivoting range of the handle 6 and, as a result, acts as protection against accidental operation of the protection switch module 2. FIG. 2 shows the protection switch module 2 with the dummy lids 15*a* mounted on it. FIG. 3 shows, in a corresponding representation, the protection switch module 2 with dummy lids 15*b* mounted on it.

As can also be seen from FIG. 1, the protection switch 1 also includes labels 20 which can be inserted into corresponding receptacles 21 of the housing 3 at the edges of the front face 4.

Figure 4:
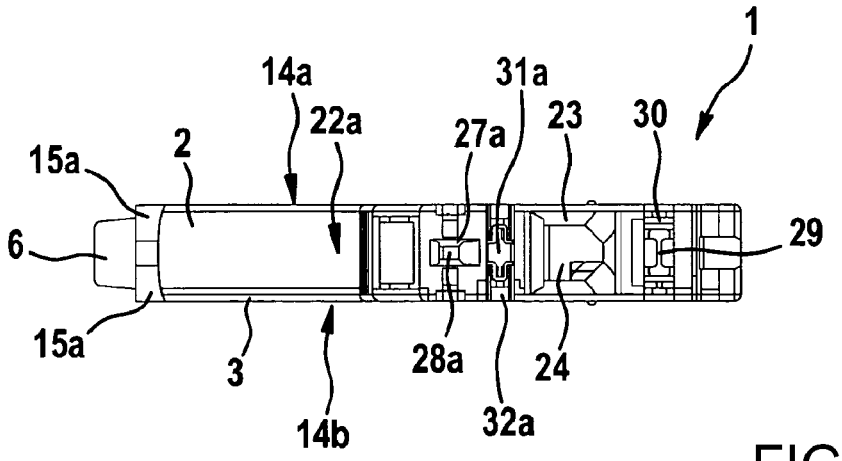
FIGS. 4 to 6 are respective top-plan, side-elevational and bottom-plan views of the protection switch according to FIG. 2.
Figure 5:
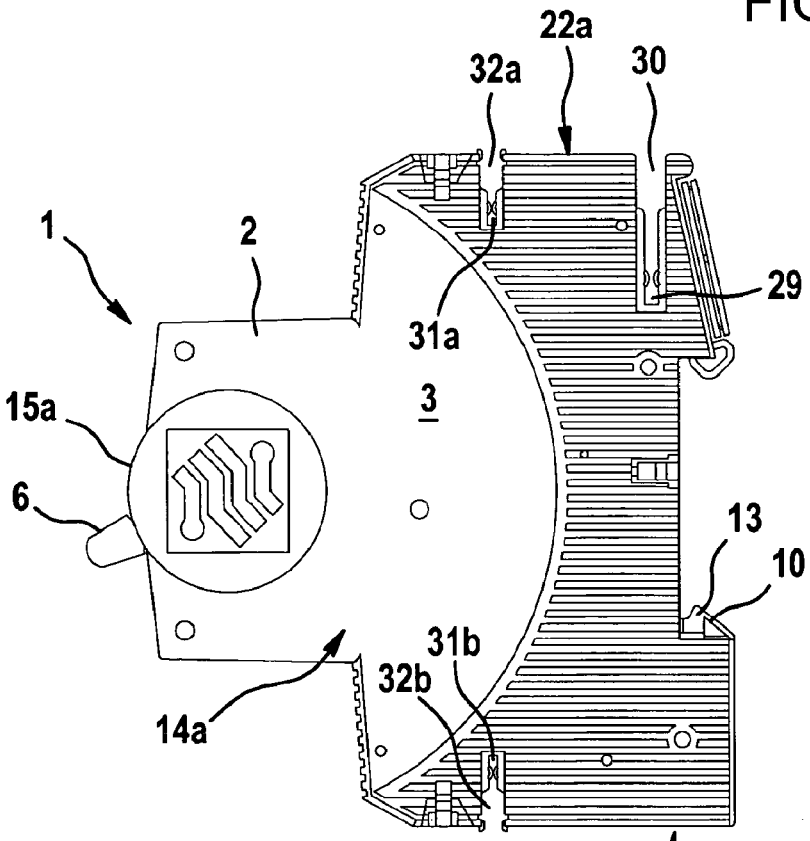
Figure 6:
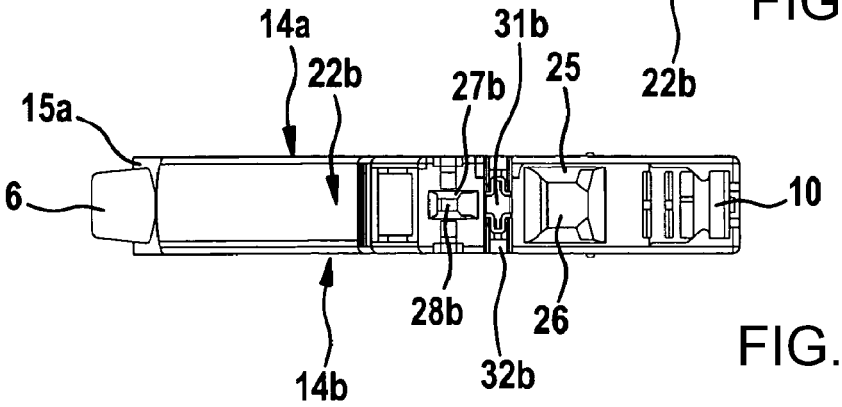

FIGS. 4 to 6 show the protection switch module 2, provided illustratively with dummy lids 15*a*, in a side view of the end face 14*a* (FIG. 5) and in top and bottom views of the adjoining side faces 22*a* (FIG. 4) and 22*b* (FIG. 6) of the housing 3.

A housing opening 23 is provided in the side face 22*a*, through which a supply connection 24 is accessible for connecting an electrical supply conductor. The opposite side face 22*b* is provided with a further housing opening 25 through which a load connection 26 is accessible. Each side face 22*a*, 22*b* is additionally provided with one respective housing opening 27*a* and 27*b* in each case, through which a respective corresponding signal connection 28*a* and 28*b* is respectively accessible. A coupling contact 29 is connected in parallel with the supply connection 24. The coupling contact 29 is made accessible from the outside through a housing slot 30. The housing slot 30 extends over the entire housing width, i.e. from the end face 14*a* to an opposite end face 14*b*, and is open towards both end faces 14*a* and 14*b*. Similarly, a further coupling connection 31*a* and 31*b* is connected in parallel with each respective signal connection 28*a* and 28*b*, with each of the coupling connections 31*a* and 31*b* being accessible through a further respective housing slot 32*a* and 32*b*.

Each housing slot 30, 32*a*, 32*b* is dimensioned in such a manner that the coupling contact 29 and 31*a*, 31*b* respectively disposed therein in each case is hidden in finger-proof manner and that the required leakage paths to the housing surface are maintained. This is achieved by the housing slots being constructed to be particularly narrow and deep. The slot depth is about 20 mm in the case of the housing slot 30 and about 10 mm in the case of the housing slots 32*a*, 32*b*. The free slot width is about 4 mm in the case of the housing slot 30 and is reduced to about 1 mm towards the outside in the rear area by guide strips 134 which flank the coupling contact 29 on both sides (see FIG. 19). In the case of the housing slots 32*a*, 32*b*, the free slot width is about 3 mm and is reduced to about 1 mm towards the outside in the rear area.

Figure 7:
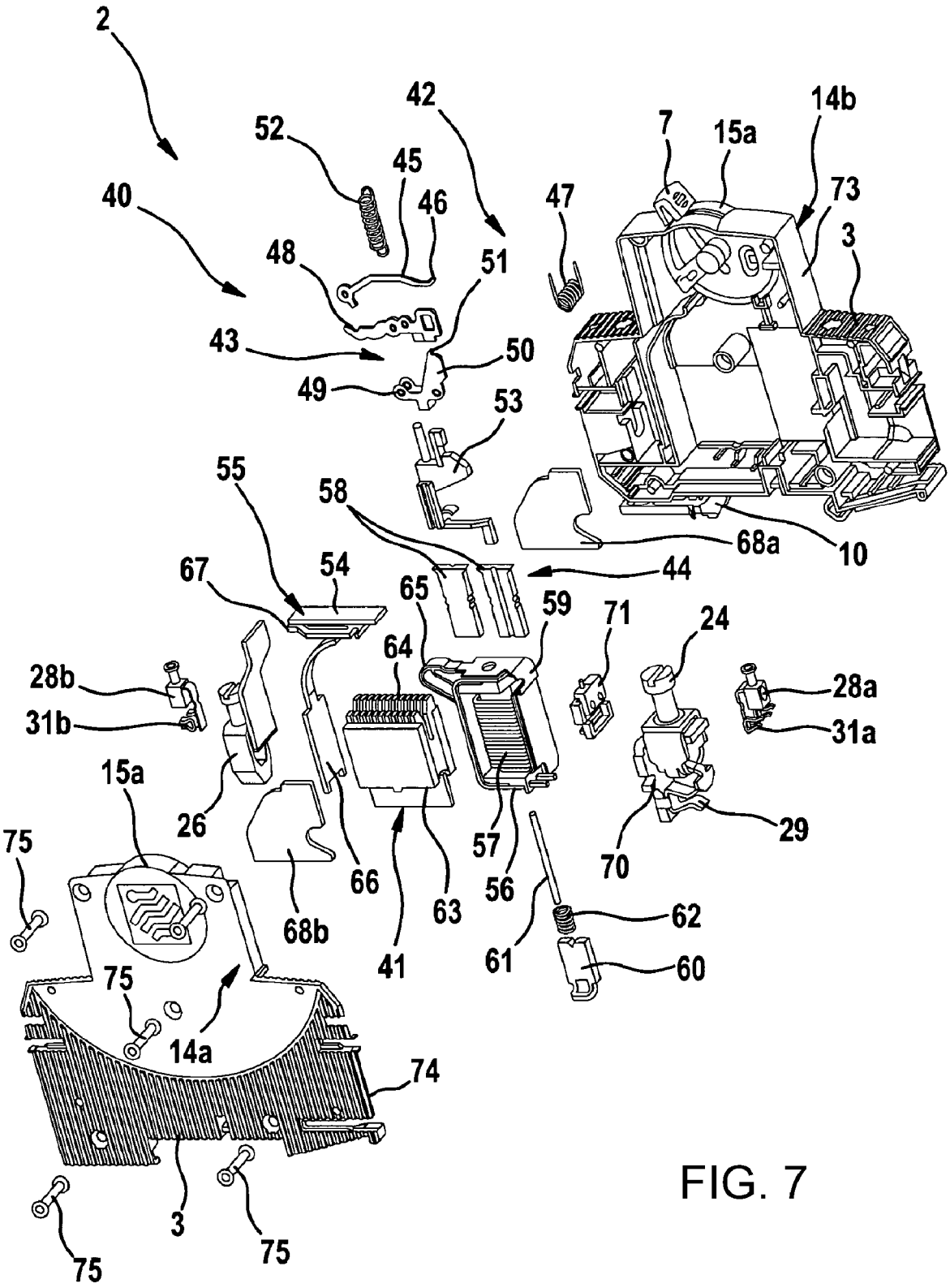
FIG. 7 is an exploded, perspective view of a housing and functional parts mounted in the housing, of the protection switch according to FIG. 2.

In FIG. 7, the protection switch module 2 is shown in an exploded representation in which, in particular, the functional parts of the protection switch module 2 accommodated in the housing 3 are visible in separate representation.

The functional parts of the protection switch module 2 are substantially disposed as a switch latch 40 and a quenching device 41. The switch latch 40, in turn, can be disposed in three functional subgroups, namely a manual operating mechanism 42, a switching arm 43 and a trip mechanism 44.

The manual operating mechanism 42 is substantially formed by the pivoted lever 7 and a coupling rod 45, the free end of which is bent away approximately at right angles to form a catch 46. The manual operating mechanism 42 also includes a torsion spring 47.

The switching arm 43 is constructed with two elements and includes a contact lever 48 and a latch lever 49 which has a latch 51 interacting with the catch 46 at a rear lever end 50. The switching arm 43 is pretensioned by a tension spring 52.

The trip mechanism 44 includes a trip slider 53, an overload trip or trip device 55 substantially formed of a bimetallic strip 54, and an electromagnetic short circuit trip or trip device 56 which includes a magnetic coil 57 with a magnetic core formed of two core discs 58, a magnetic yoke 59 and a magnetic armature 60. In this configuration, the magnetic armature 60 is connected to a rod-shaped plunger 61 of plastic and is pretensioned by a compression spring 62.

The quenching device 41 includes a quenching chamber 63 with a packet, inserted therein, of quenching plates 64 disposed in parallel with one another and a first running rail 65 and second running rail 66. In this configuration, the running rail 65 is constructed integrally with the magnetic yoke 59. The running rail 66, together with a current supply 67, is formed as an integrally coherent metal part, with the current supply 67 at the same time forming a carrier for the bimetallic strip 54. The quenching device 41 also includes two cover plates 68*a* and 68*b* and guide plates 69 (see FIG. 8) which are molded integrally on the inside wall of the housing 3.

FIG. 7 also shows the supply connection 24 constructed as a screw terminal contact which is connected in parallel with the coupling contact 29 through a rigid current rail 70, and the load connection 26 which is also constructed as a screw terminal contact.

The protection switch module 2 also includes a signal contact device which is substantially formed by a signal relay 71 that is interconnected with the signal connections 28*a* and 28*b* and the coupling contacts 31*a* and 31*b* which are in each case connected in parallel.

FIG. 7 also shows that the housing 3 is formed of two parts, namely a housing shell 73 and a housing lid 74 which can be placed onto the former. The housing shell 73 and the housing lid 74 are fixed captively to one another by rivets 75 or screwed connections in the assembled state.

Figure 8:
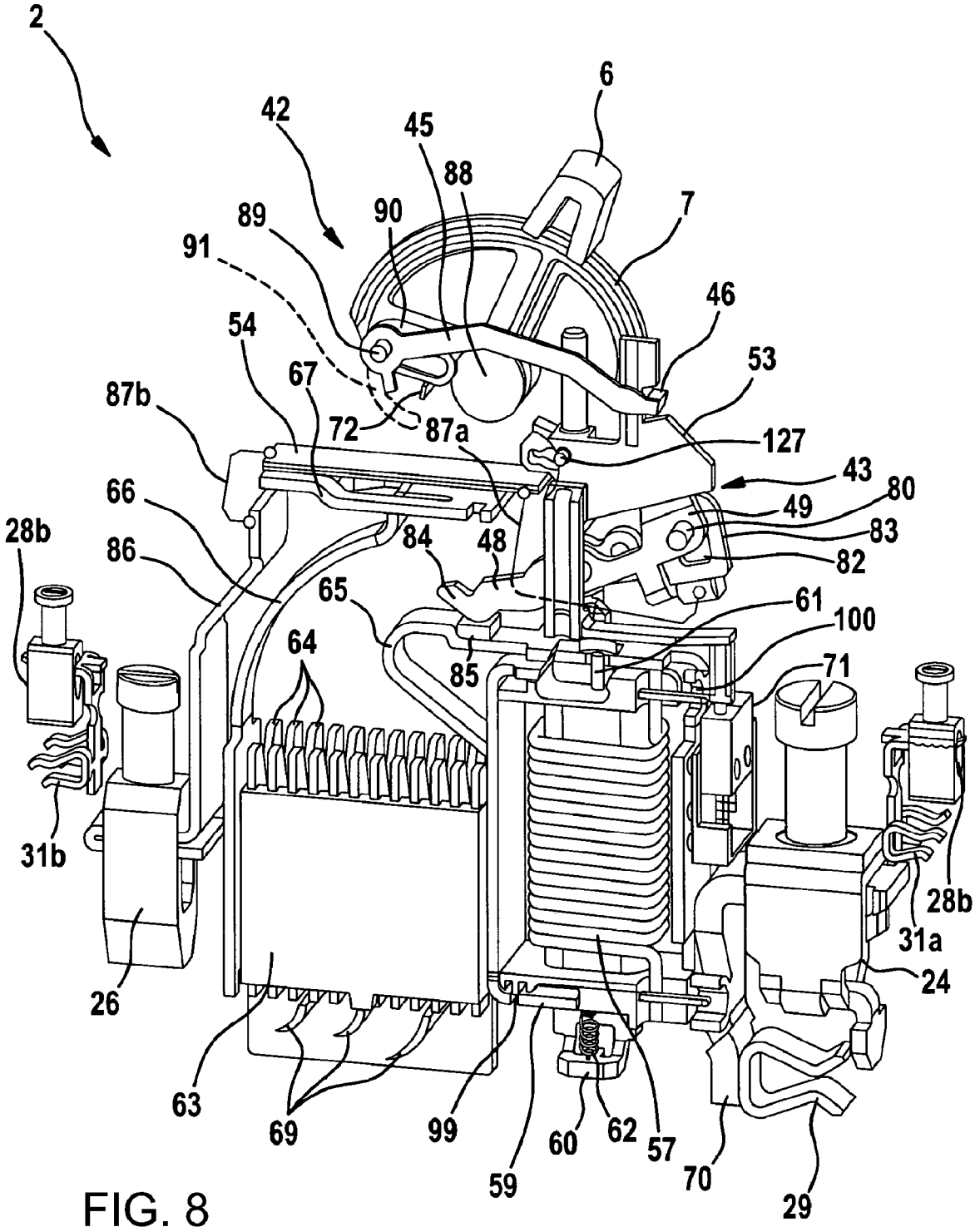
FIG. 8 is a perspective view of the functional parts shown in FIG. 7, of the protection switch according to FIG. 2, in an assembled state.
Figure 9:
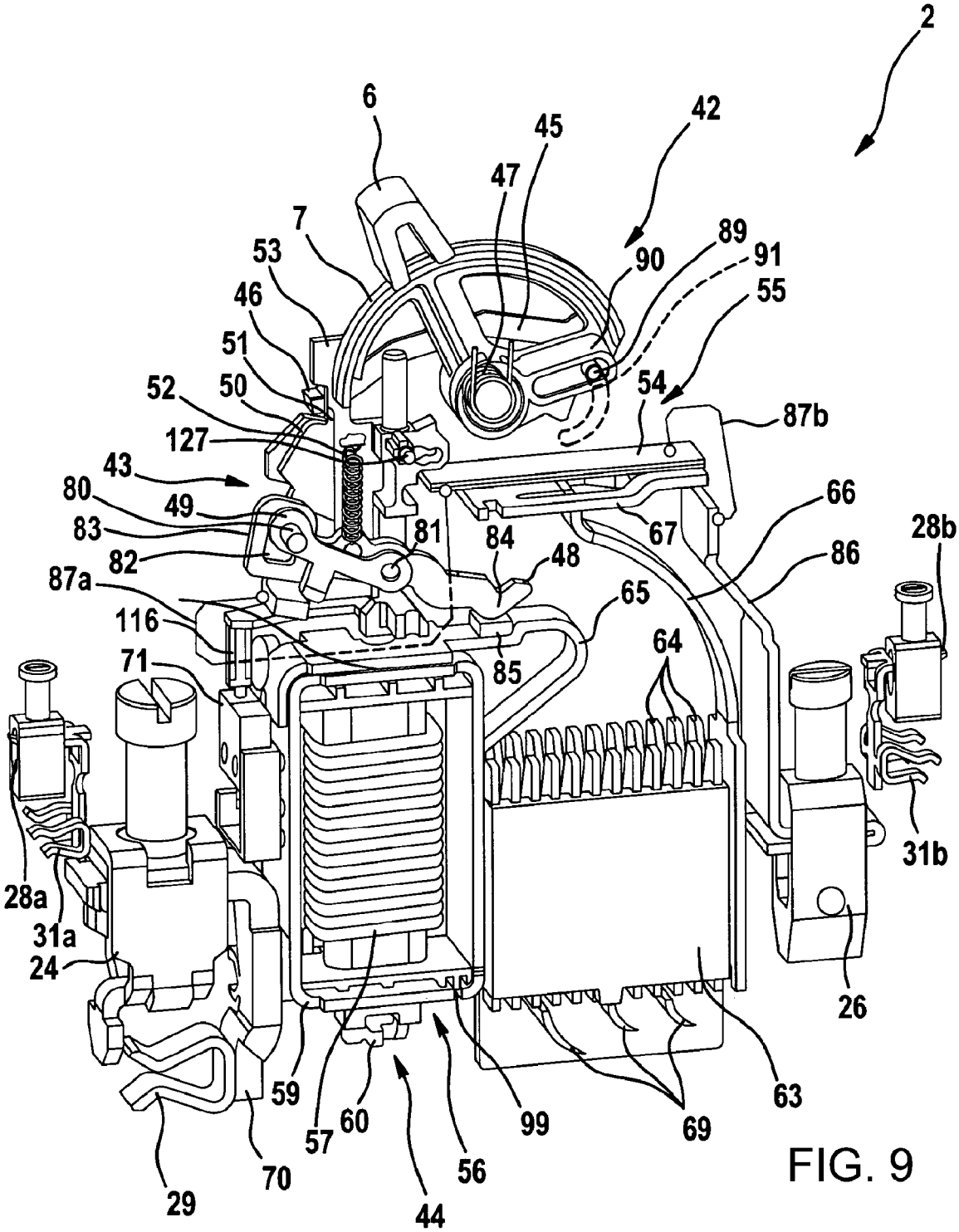
FIG. 9 is a perspective view, rotated by about 180° compared with FIG. 8, of the functional parts of the protection switch according to FIG. 2 in the assembled state.

FIGS. 8 and 9 show the functional parts, described above, of the protection switch module 2 in the assembled state, wherein FIG. 8 represents a front view of the functional parts which would be obtained in a view through the housing lid 74 onto the functional parts inserted into the housing shell 73. FIG. 9 shows the functional parts in a rear view which would be obtained with a view through the bottom of the housing shell 73. The housing shell 73 and the housing lid 74 have been left off for reasons of better clarity in FIGS. 8 and 9.

In the assembled state, the latch lever 49 of the switching arm 43 is supported pivotably around a housing-fixed hinge pin 80. The contact lever 48, in turn, is pivoted at a hinge 81 at the latch lever 49 so that the switching arm 43 has a certain flexibility per se. The relative mobility of the contact lever 48 with respect to the latch lever 49 is limited by an elongated hole 82 at a rear end 83 of the contact lever 84 through which the hinge pin 80 protrudes.

The free end of the contact level 48, opposite to the rear end 83, forms the moving contact 84 which interacts with a fixed contact 85 for switching a circuit. The fixed contact 85 is attached at a top of the magnetic yoke 59 on the shoulder of the running rail 65 integrally connected to it.

FIGS. 8 and 9 show the protection switch module 2 in a closed position of the switching arm 43 in which the end of the contact lever 48 forming the moving contact 84 rests against the fixed contact 85. In this closed position, an electrically conductive connection leading through the current rail 70, the magnetic coil 57, the magnetic yoke 59, the fixed contact 85, the contact lever 48 with the moving contact 84, the bimetallic strip 54 and an adjoining current rail 86 is created between the supply connection 24 or coupling contact 29, respectively, and the load connection 26. The electrical connection between the rear end 83 of the contact lever 48 and the bimetallic strip 54 and between the bimetallic strip 54 and the current rail 86 is in each case closed by a stranded connection 87*a*, 87*b* which is only indicated diagrammatically in FIGS. 8 and 9.

The tension spring 52 (which is also only diagrammatically indicated in FIG. 9) engages the contact lever 48 at a position disposed between the hinge 81 and the elongated hole 82 (and thus also between the hinge 81 and the hinge pin 80). The opposite end of the tension spring 52 is abutted at the housing 3. The switching arm 43 is thus pretensioned in the direction of an open position by the tension spring 52 overall in a direction of rotation which corresponds to a rotation of the switching arm 43 in the clockwise direction in the representation according to FIG. 8, to a rotation of the switching arm 43 in the anticlockwise direction in the representation according to FIG. 9. In contrast, as a consequence of the point of attack of the tension spring 52 located between the hinge 81 and the hinge pin 80, the contact lever 48 is pretensioned in the opposite direction of rotation, i.e. in the direction of the closed position relative to the latch lever 49. The switching arm 43 is held in the closed position against the restoring force of the tension spring 52 by the latch 51 being latched to the catch 46.

In this configuration, the position of the latch arm 49 in this closed position is selected in such a manner that the switching arm 43 is "pressed through" to a certain extent during the closing so that the contact lever 48 is thus braced with respect to the latch lever 49. The result of this bracing is that the moving contact 84 always rests against the fixed contact 85 at a pretension in the closed position. In this way, a progressively increasing consumption of contact material in the course of the life of the protection switch module 2 is compensated by the resilience of the contact lever 48.

The pivoted lever 7 is supported pivotably around a housing-fixed swivel pin 88 between a first pivoted position shown in FIG. 7 and a second pivoted position shown in FIGS. 8 and 9 wherein, as can be seen in FIGS. 8 and 9, the second pivoted position of the pivoted lever 7 corresponds to the closed position of the switching arm 43. The coupling rod 45 is guided pivotably at a fixed end 89 and radially movably with respect to the pivoted lever 7 in a radial guide 90 of the pivoted lever 7. The fixed end 89, on the other hand, is guided in a rocker guide 91 which is molded onto the inside wall of the housing shell 73 and of the housing lid 74 and is only diagrammatically indicated in FIGS. 8 and 9. The rocker guide 91 extends towards the swivel pin 88 in a manner of a spiral segment, with there being a point of intersection of the linear guide 90 and the rocker guide 91 for each position of the pivoted lever 7 between the first and the second pivoted position, which point defines a position of the fixed end 89 of the coupling rod 45 corresponding to this position of the pivoted lever 7. Along the rocker guide 91, the fixed end 89 of the coupling rod 45 is at its radially extreme point with respect to the swivel pin 88 when the pivoted lever 7 is in the second pivoted position, and at its radially innermost point when the pivoted lever 7 is located in the first pivoted position. In this context, the coupling rod 45 is mainly guided linearly during a pivoting of the pivoted lever 7 due to the interaction of the radial guide 90 with the rocker guide 91.

The pivoted lever 7 is pretensioned in the direction of the first pivoted position by the torsion spring 47 so that it is deflected against the spring pressure of the torsion spring 47 in the second pivoted position. The rocker guide 91 in this case is disposed in such a manner that in the second pivoted position, the active connection between the catch 46 and the fixed end 89 conveyed through the coupling rod 45 extends above (i.e. on the side facing the handle 6) the swivel pin 88 so that the pivoted lever 7 is held in the second pivoted position against the restoring force of the torsion spring 47 due to the locking of the catch 46 to the latch 51 of the locking arm 43. The manual operating mechanism 42 and the switching arm 43 are thus coupled to one another through the latching of the catch 46 to the latch 51 in such a manner that they stabilize mutually in the closed position or the second pivoted position, respectively, against the respective restoring force of the tension spring 52 and of the torsion spring 47.

The core component of the trip mechanism 42 is the trip slider 53 which is operated both by the bimetallic strip 54 of the overload trip device 55 and by the plunger 61 of the short circuit trip 56 and which, under actuation by one of the trips 55 or 56, effects the resetting of the switching arm 43 from the closed position into the open position. The trip slider 53 influences this resetting process in two ways, on one hand by unlatching the switching arm 53 from the catch 46 and thus initiating the automatic resetting process of the switching arm 43 under the action of the tension spring 52, and, on the other hand, by "giving a push" to the switching arm 43, that is to say imparting impulse to it so that the inertia of the switching arm 43 is overcome more rapidly during the resetting and the switching process is thus accelerated.

The tripping process for the short circuit case is illustrated in the manner of "snapshots" in FIGS. 10 to 13.

Figure 10:
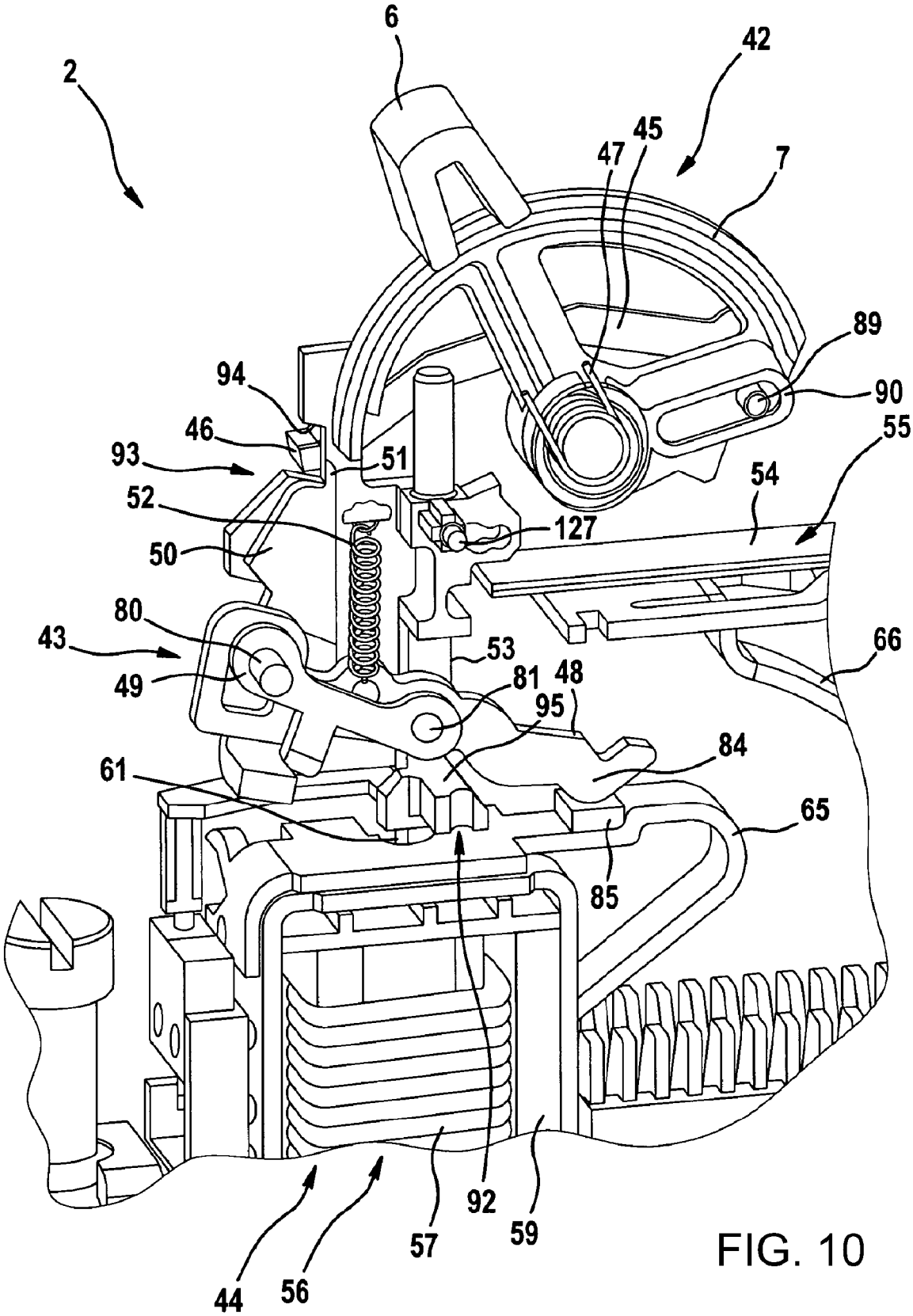
FIGS. 10 to 13 are enlarged (and partially slightly rotated), fragmentary, perspective views in a representation according to FIG. 9, illustrating a switching cycle of the protection switch according to FIG. 2 during a tripping process in progressively successive representations.
Figure 11:
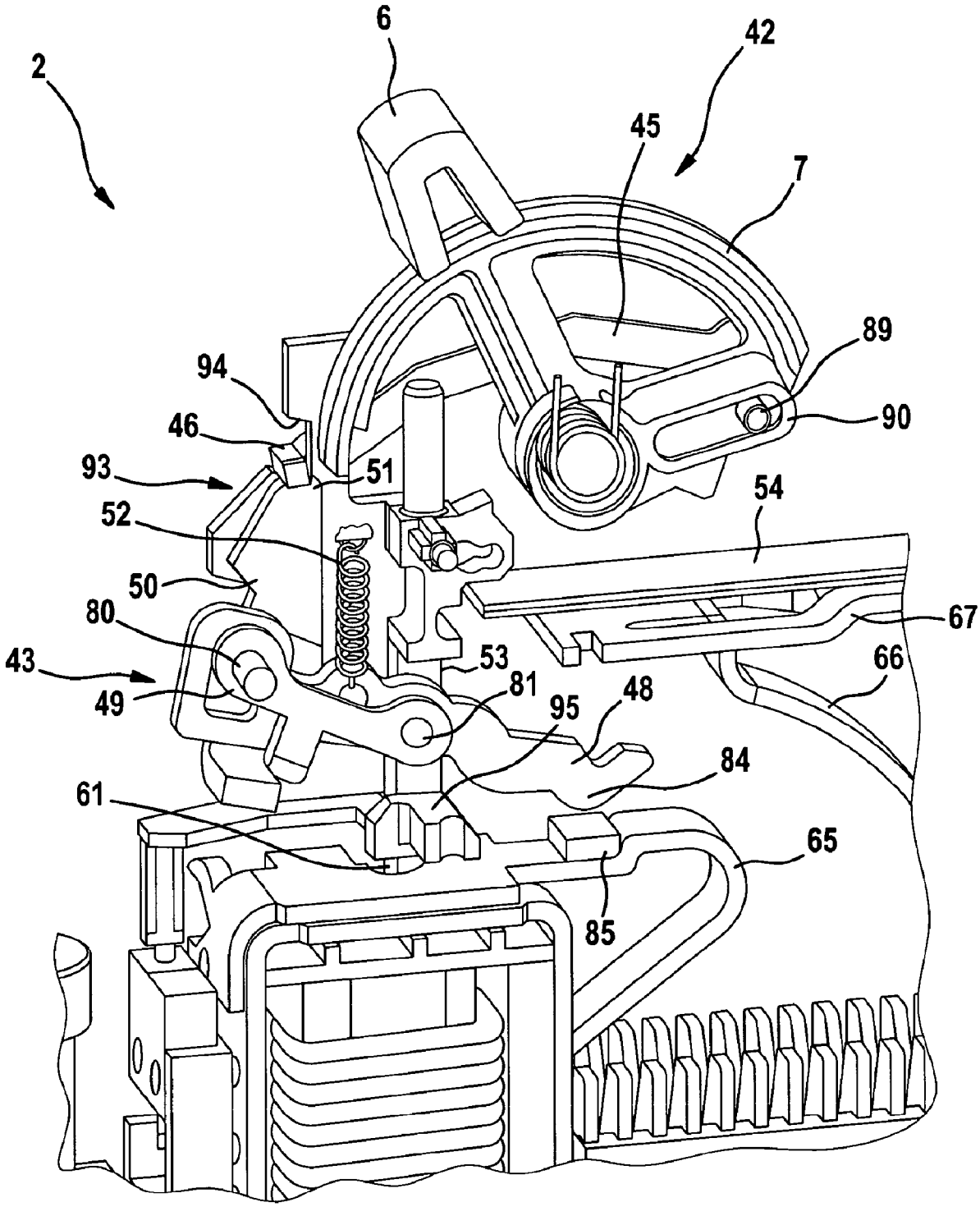

FIG. 10 is an enlarged representation showing the switching arm 43 again in its closed position in which the electrical connection, conducted through the magnetic coil 57, among other things, is closed between the supply connection 24 and the load connection 26. A short circuit in a circuit connected to the connections 24 and 26 leads to an abrupt rise in the current flowing through the magnetic coil 57 to a peak value which, as determined, can be up to approximately 6 kA in the case of the protection switch shown. This strong current rise produces a proportional rise in the magnetic field generated by the magnetic coil 57, as a consequence of which the magnetic armature 60 is attracted against the core discs 58 disposed in the interior of the magnetic coil 57, against the restoring force produced by the compression spring 62.

Each of the core discs 58 is provided with a longitudinal slot. The core discs 58 in this configuration are placed next to one another in such a manner that the longitudinal slots complement each other to form a lead through in which the plunger 61 rests slidingly. The plunger 61 is joined with the magnetic armature 60 and is pushed forward against the trip slider 53 when the former moves. In doing so, it stops against a stop surface 92 of the trip slider 53 and with continued advance lifts the trip slider 53 out of the ready position shown in FIG. 9.

The trip slider 53 has an unlatching contour 93 in order to unlatch the catch 46 from the latch 51. The unlatching contour 93 is provided with a recess 94 which is engaged by the coupling rod 45 with the catch 46 so that the catch 46 is pulled away from the latch 51 of the latch lever 49 by the advance of the trip slider 53.

The trip slider 53 is also provided with a projection which is used as a stop 95 for impinging on the switching arm 43. Simultaneously with or immediately after the unlatching of the switching arm 43, this (first) stop 95 impinges on the former and accelerates the switching arm 43 in the direction of its open position. In particular, the geometry of the trip slider 53 is dimensioned in such a manner that the stop 95 comes to rest against the switching arm 43 at a time at which the switching arm 43 has not yet released its tension. The switching arm 43, in turn, is constructed in such a manner that the stop 95 stops against the contact lever 48 (and not against the latch lever 49). The rotational mobility of the contact lever 48 is blocked by the friction of the contact lever 48 with the stop 95. This prevents the switching arm 43 from releasing its tension before the moving contact 84 lifts away from the fixed contact 85. Instead, the contact lever 48 is lifted immediately when the trip slider 53 hits (see FIG. 11), as a result of which, in turn, the moving contact 84 is immediately separated from the fixed contact 85 and the short circuit current is effectively limited already in the rising phase.

In particular, the trip slider 53 is disposed in such a manner that the stop 95 impinges on the switching arm 43 in the area of the hinge 81 so that no torque relative to the latch lever 49 is transmitted to the contact lever 48 by the stop 95. The contact lever 48 protrudes over the latch lever 49 in the radial direction in the area of the hinge 81 which ensures that the stop 95 impinges on the contact lever 48.

Figure 12:
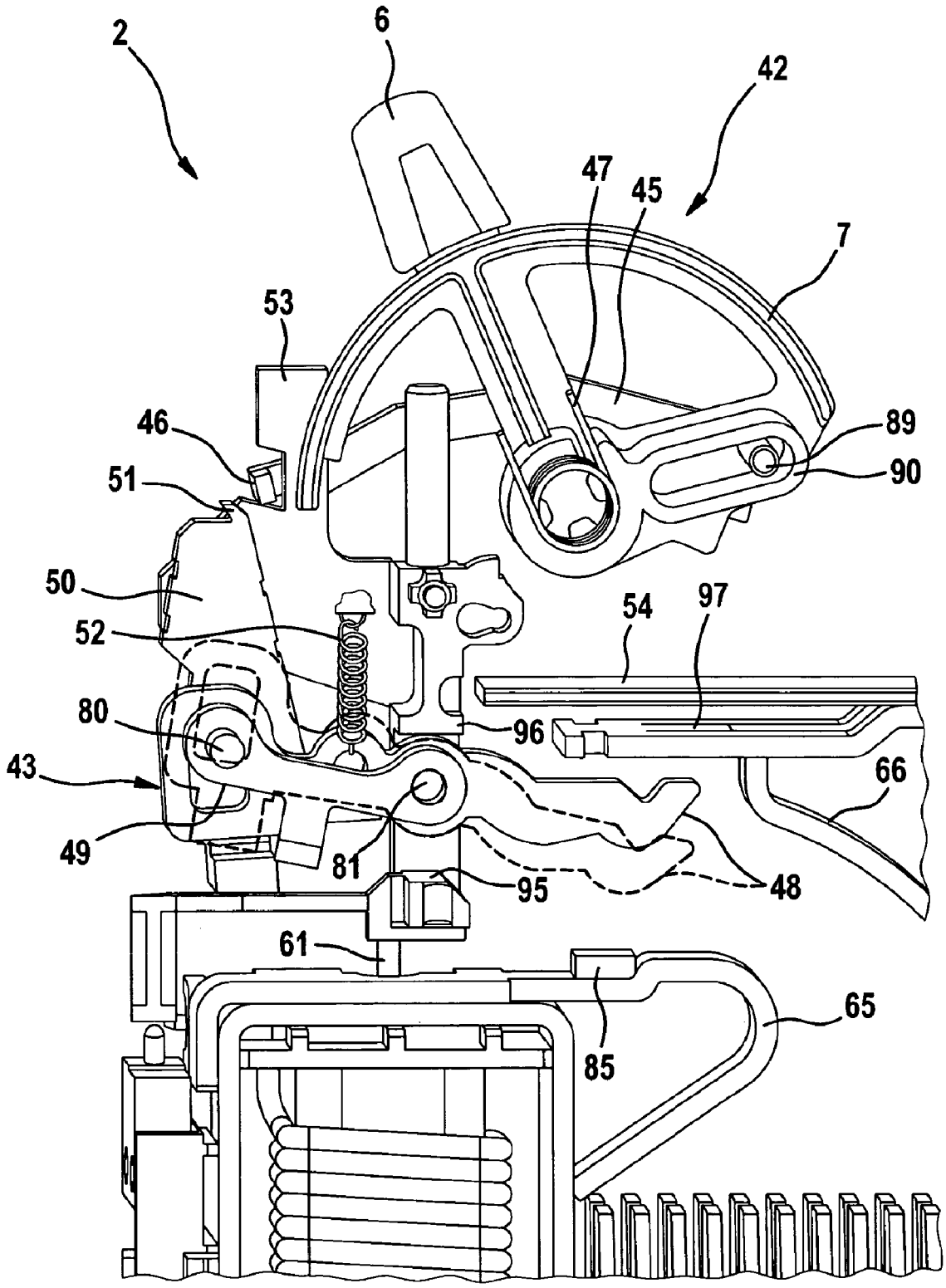

As is shown in FIG. 12, the advance of the plunger 61, and as a consequence thereof also the advance of the trip slider 53, stops due to the limited travel of the short circuit trip device 56 in a subsequent tripping phase. The switching arm 43 continues to move in the direction of the open position under the action of the tension spring 52 and, as a result, lifts away from the stop 95. This also cancels the rotational fixing of the contact lever 48 so that the switching arm releases its tension (the position of the contact lever 48 in the released state of the switching arm 43 is indicated in dashed lines in FIG. 12).

Before the contact lever 43 reaches its open position, it impinges on a second stop 96 of the trip slider 53, again in the area of the hinge 81, and takes it along with continued withdrawal into the open position.

Figure 13:
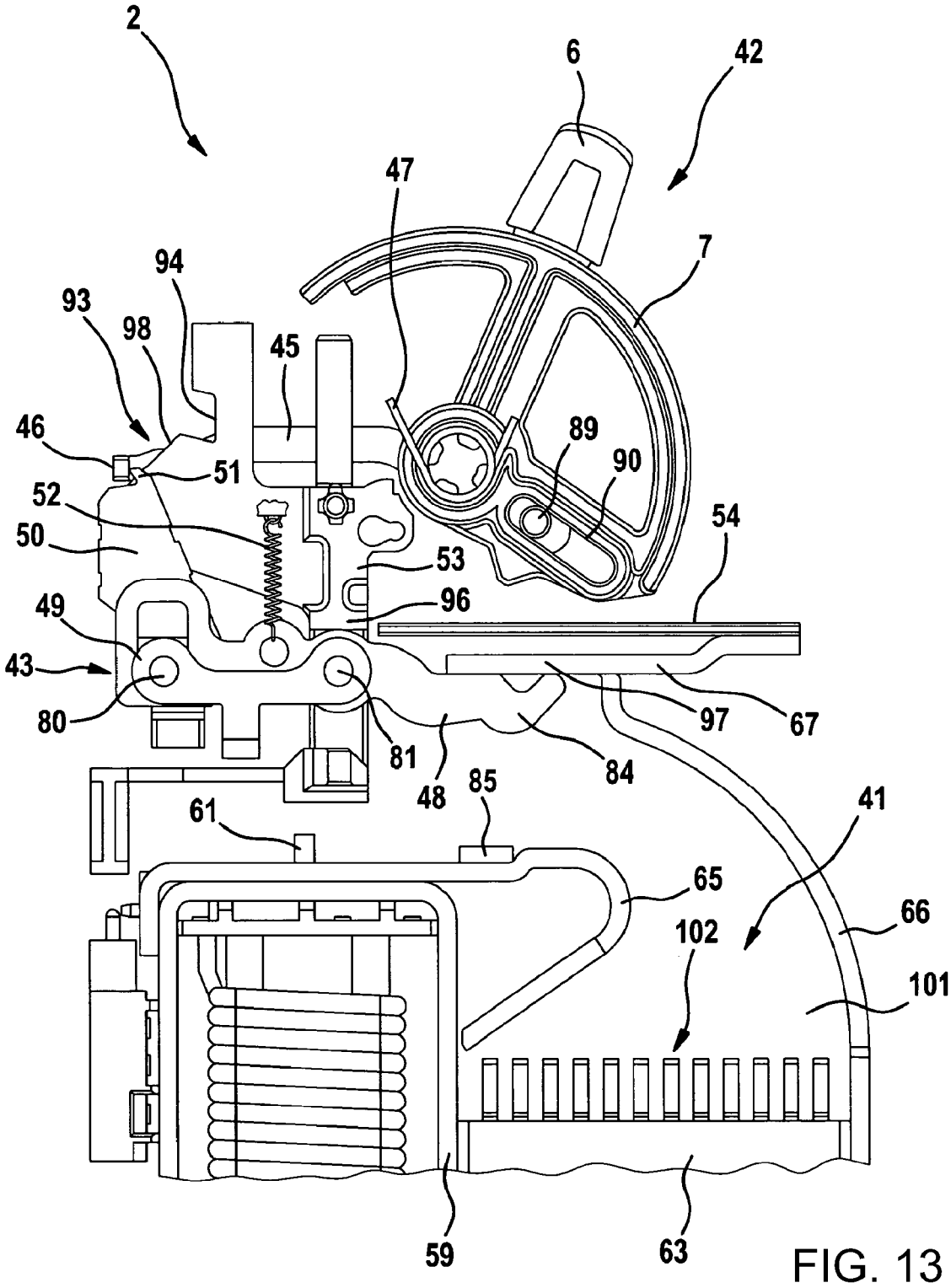

FIG. 13 shows the final state of the tripping process in which the moving contact 48 rests against a stopping surface 97 which forms a shoulder of the second running rail 66 that is opposite the fixed contact 85 at a distance. Due to the interaction of the second stop 96 with the switching arm 43, the trip slider 53 is raised into a tripping position in which the unlatching contour 93 of the trip slider 53 flanks the latch 51 of the switching arm 43 with a slide-up slope 98.

Once the catch 46 with the latch 51 is unlatched during the tripping process, the pivoted lever 7 is also no longer held in the second pivoted position and returns into the first pivoted position under the action of the torsion spring 47. During this process, the catch 46 is pushed out of the recess 94 of the unlatching contour 93 and slides down the slide-up slope 98 until it locks in again behind the latch 51. The locking-in of the catch 46 behind the latch 51 is ensured by a spring lug 72 (FIG. 8) which is integrally molded onto the pivoted lever 7 and presses the coupling rod 45 against the slide-up slope 93 in the second pivoted position of the pivoted lever 7. As a result, the switching arm 43 is coupled again with the manual operating mechanism 42 and can be reset by manually pivoting the pivoted lever 7 into the closed position according to FIG. 9. During this process, the trip slider 53 is simultaneously pushed back into the ready position according to FIG. 9 due to interaction of the catch 46 with the slide-up slope 89 if there is no obstacle in the way of displacing the trip slider 53. Otherwise, e.g. if the trip condition still exists and correspondingly one of the trips 55 or 56 opposes a displacement of the trip slider into the ready position, the catch 46 slides upward on the slide-up slope 98 and, as a result, is lifted off the latch 51 again.

In the course of the tripping process described above, a switching arc arises between the fixed contact 85 and the moving contact 84 lifting away from the former. The arc leads to great heating and, in the long term, to a burning-off of the contacts 84 and 85. In this context, the quenching device 41 is used for rapidly and effectively quenching the arc.

When the contacts 84 and 85 open, the current flow within the contact lever 48, the arc path and the path of the magnetic yoke 95 opposite the contact lever 48 act as a current loop. This current loop exerts an induction force on the arc which drives the arc in the direction of the quenching chamber 63.

When the switching arm 43 impinges on the stopping surface 97, the conductive connection between the bimetallic strip 54, the stranded connection 87*a* (FIGS. 8 and 9) and the contact lever 48 is short circuited through the current supply 67. The shaping of the metal strip, of which the current supply 67 and the running rail 66 are integrally formed, ensures that the sign of the induction effect of the current flow on the arc is maintained during this process: the running rail 66 is cut out of the current supply 67, as can be seen, in particular, from looking at FIGS. 10 to 13 together, in such a manner that the running rail 66, in the area of the stopping surface 97, is conducted along the contact lever 48 resting against the former in its open position, and passes into the current supply 67 only after the moving contact 84, as seen along the contact lever 48 from the moving contact 84. The current conducted from the fixed contact 85 through the arc gap to the moving contact 84 thus has to flow a certain distance in the direction of the rear lever end 83, even if the contact lever 48 is already resting against the stopping surface 97, as before the impingement of the contact lever 48, within the contact lever 48 or the running rail 66 until it is diverted in the opposite direction through the current supply 67. In this configuration, the running rail 66 is centrally cut out of the current supply 67 to ensure a symmetric current flow in the transition area.

In consideration of the electrodynamic effect of the current path, the magnetic yoke 59 in which the running rail 65 is integrated is not closed circularly around the magnetic coil 57, either. Instead, the magnetic yoke 59 is interrupted at an underside facing the magnetic armature 60 by a narrow air gap 99 (FIGS. 8 and 9). The air gap 99 is dimensioned in such a manner that it does not significantly impair the magnetic flow within the magnetic yoke 59 but effectively suppresses a current flow through the gap distance. Instead, a current path directed from an output 100 (FIG. 8) of the magnetic coil 57 in the direction of the fixed contact 85 and, if necessary, beyond the latter is forcibly maintained (in the context of the present description, the direction of the current path is specified independently of the actual direction of current flow as starting from the supply connection 24 or coupling contact 29, respectively, and oriented towards the load connection 26).

Overall, the geometric characteristic of the current flow within the protection switch module 2 and the resultant induction effect is retained over the entire tripping process up to the extension of the arc.

Under the induction effect, the arc becomes detached from the contacts 84 and 85 after the contact lever 48 impinges on the stopping surface 97, and moves to the adjoining running rails 65 and 66. This process is called commutation. The arc subsequently wanders along the running rails 65 and 66, still under the influence of the electrodynamic forces, in an arc running space 101 formed between them (FIG. 13) towards an inlet 102 (FIG. 13) of the quenching chamber 63.

The arc enters into the quenching chamber 63 through the inlet 102 and is divided into a number of partial arcs by the quenching plates 64. The quenching plates 64 promote the quenching of the arc in a manner known per se in that the total voltage dropped across the entire arc gap is multiplied and the arc is cooled.

Due to the arc, the air is greatly heated locally as a result of which a pressure wave is produced in the arc running space 101 which is pushed before the arc during its propagation in direction of the quenching chamber 63. In order to prevent this pressure wave from impeding the entry of the arc into the quenching chamber 63 or the negative pressure produced after the cooling of the air from sucking the arc back into the area of the contacts 84 and 85, the quenching device 41 is provided with an air balancing system, the operation of which is illustrated diagrammatically in FIG. 14.

Figure 14:
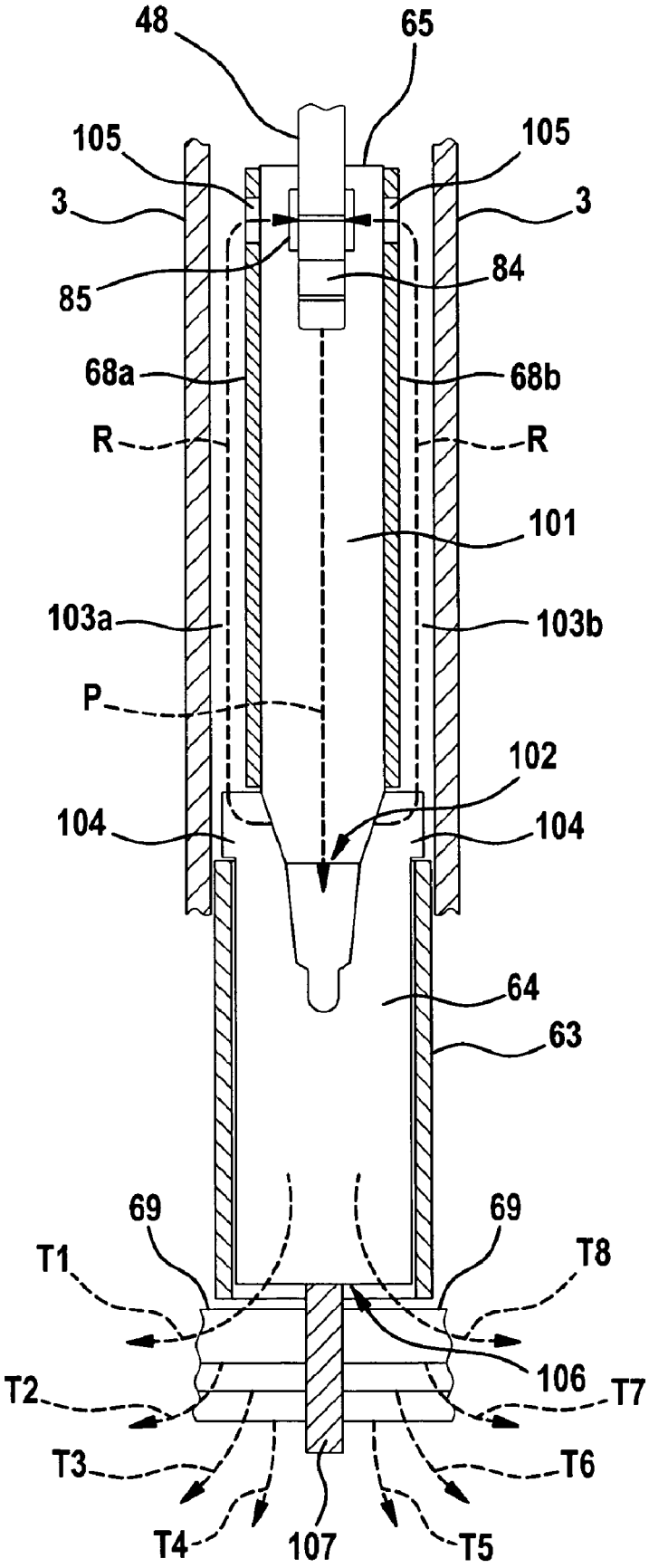
FIG. 14 is a fragmentary, simplified, longitudinal-sectional view of a quenching device of the protection switch according to FIG. 2.

FIG. 14 shows the quenching device 41 in a diagrammatic section through the quenching chamber 63 and the arc running space 101 along a section line which coincides approximately with the running rail 66. This representation illustrates that the arc running space 101 is closed off towards both end faces by the cover plates 68*a* and 68*b*. Each cover plate 68*a*, 68*b*, in turn, is disposed at a distance from the adjoining wall of the housing 3 so that a pressure compensating duct 103*a* and 103*b* is respectively formed on both sides of the arc running space 101 and in parallel with the latter between the cover plates 68*a*, 68*b* and the housing 3. Each pressure compensating duct 103*a*, 103*b* corresponds through a first opening 104 with an area of the arc running space 101 adjacent the inlet 102 and with a second opening 105 let into the respective cover plate 68*a*, 68*b*, with an area, surrounding the contacts 84, 85, of the arc running space 101. Under the action of the pressure wave propagating with the arc in its direction of propagation P, a return flow R occurs in the pressure compensating ducts 103*a*, 103*b*, through the use of which an overpressure at the inlet of the quenching chamber 63 is removed and the production of an underpressure is avoided in the area of the contacts 84 and 85.

The quenching chamber 63 has an outlet 106 (FIG. 14) at the end opposite the inlet 102. A damming up of this outlet 106 occurs, i.e. the ratio of the free cross sectional area of the outlet 106 with respect to the free cross sectional area of the inlet 102, is about 42%. This cross sectional narrowing has been found to be particularly suitable for retarding, on one hand, the propagation of the arc in the quenching chamber 63 in order to avoid the arc from simply running through the quenching chamber 63 and arcing back at the outlet 106 but, on the other hand, for keeping the quenching chamber sufficiently transmissive so that the arc rapidly runs into the quenching chamber 63.

The damming is substantially caused by a separating strip 107 of insulating material which is molded onto the outlet 106 of the quenching chamber 63 and protrudes from there in the direction of propagation P. This separating strip 107 also produces a separation of the gas stream leaving the quenching chamber 63 into two partial-streams and thus further impedes an arcing-back of the arc.

The gas stream experiences a further subdivision into (diagrammatically indicated) partial-streams T1 to T8 by the guide plates 69 molded onto the housing 3, three of which in each case flank the separating strip 107 on both sides. The guide plates 69 also divert the partial-streams T1 to T8 in the direction of the side face 22*b* (i.e. approximately towards the observer in the representation according to FIG. 14) and thus avoid a pressure increase at the outlet 106 of the quenching chamber 63 which would promote the arcing back of the arc.

Figure 15:
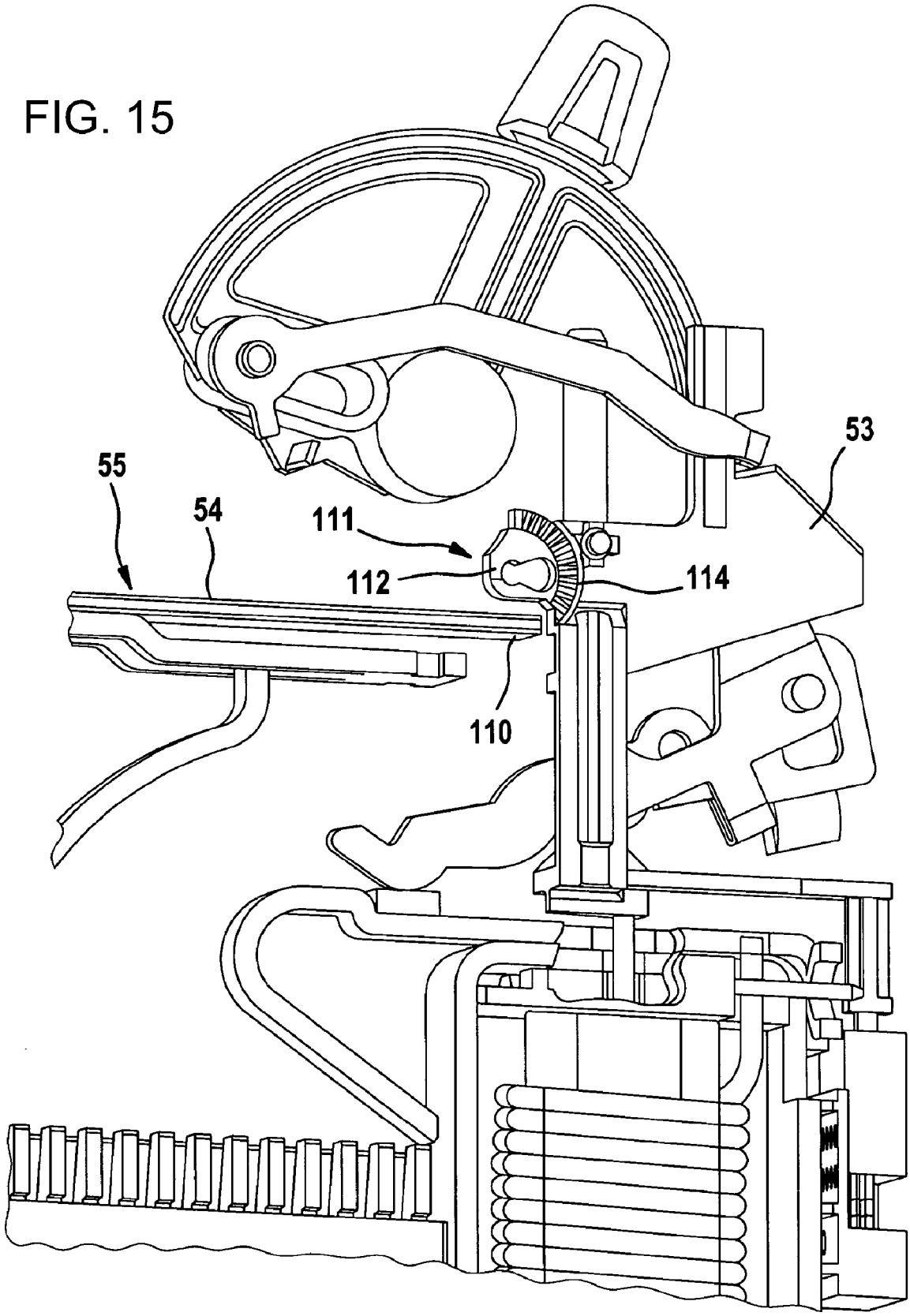
FIGS. 15 and 16 are fragmentary, perspective views (basically corresponding to the view according to FIG. 8) of an alignment device for adjusting a response threshold of a bimetallic overload trip device of the protection switch according to FIG. 2.

In the overload case, tripping occurs basically in the same manner as in the short circuit case described above. However, the trip slider 53 is advanced in this case not by the plunger 61 of the short circuit trip device 56 but by the bimetallic strip 54 of the overload trip device 55 which heats up due to the overload current and, in doing so, bends outward in such a manner that its free end 110 (FIG. 15) stops against a projection of the trip slider 53 which is referred to as a toe 111 in the text which follows.

Figure 16:
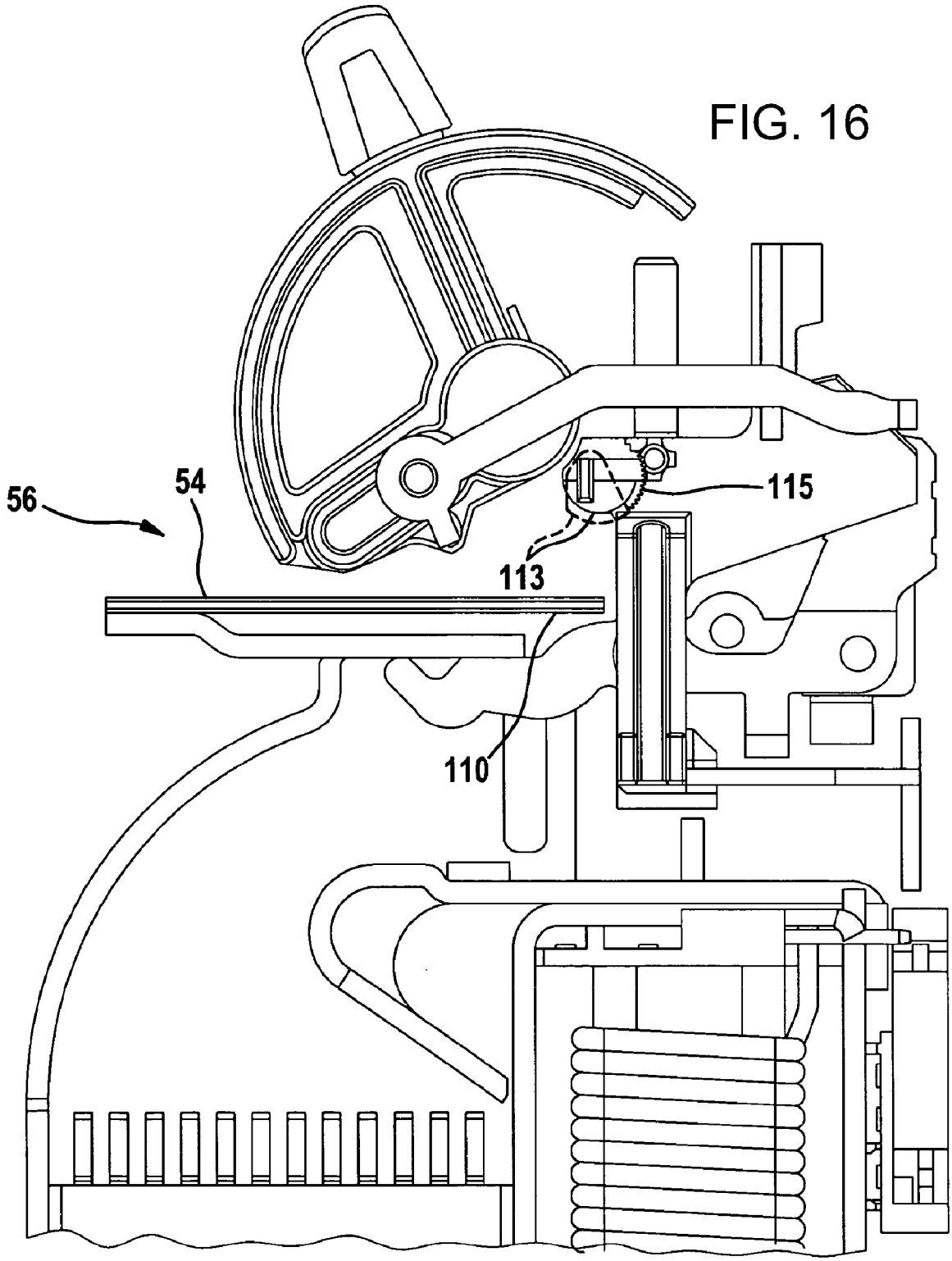

In order to adjust the tripping threshold of the protection switch module 2 in the overload case, the toe 111 is constructed in two parts and includes a holder 112 molded onto the trip slider 53 (FIG. 15) on which a cam 113 (FIG. 16) is rotatably placed. In this configuration, the holder 112 is provided with a toothed ring 114 (FIG. 15) which, in interaction with a corresponding locking tooth 115 (FIG. 16) of the cam 113, enables the cam 113 to be locked in several defined pivoted positions with respect to the holder 112. By rotating the cam 113 with respect to the holder 112, it is then possible to vary the distance assumed by the toe 111 in the ready position of the trip slider 53 to the free end 110 of the bimetallic strip 54 (this effect is illustrated in FIG. 16 through the use of two pivoted positions in which the cam 113 is respectively shown by way of example with continuous and dashed lines).

In order to operate the signal relay 71, the trip slider 53 also includes an extension arm 116 (FIG. 9). The extension arm 116 is constructed in such a manner that it operates the signal relay 71 when the trip slider 53 is in the ready position. As can be seen from looking at FIGS. 10 to 13 together, the extension arm 116 releases the signal relay 71 during its movement into the trip position. It is thus possible to interrogate the position of the trip slider 53 and thus the state of the tripping mechanism 44 through the switching state of the signal relay 71.

Figure 17:
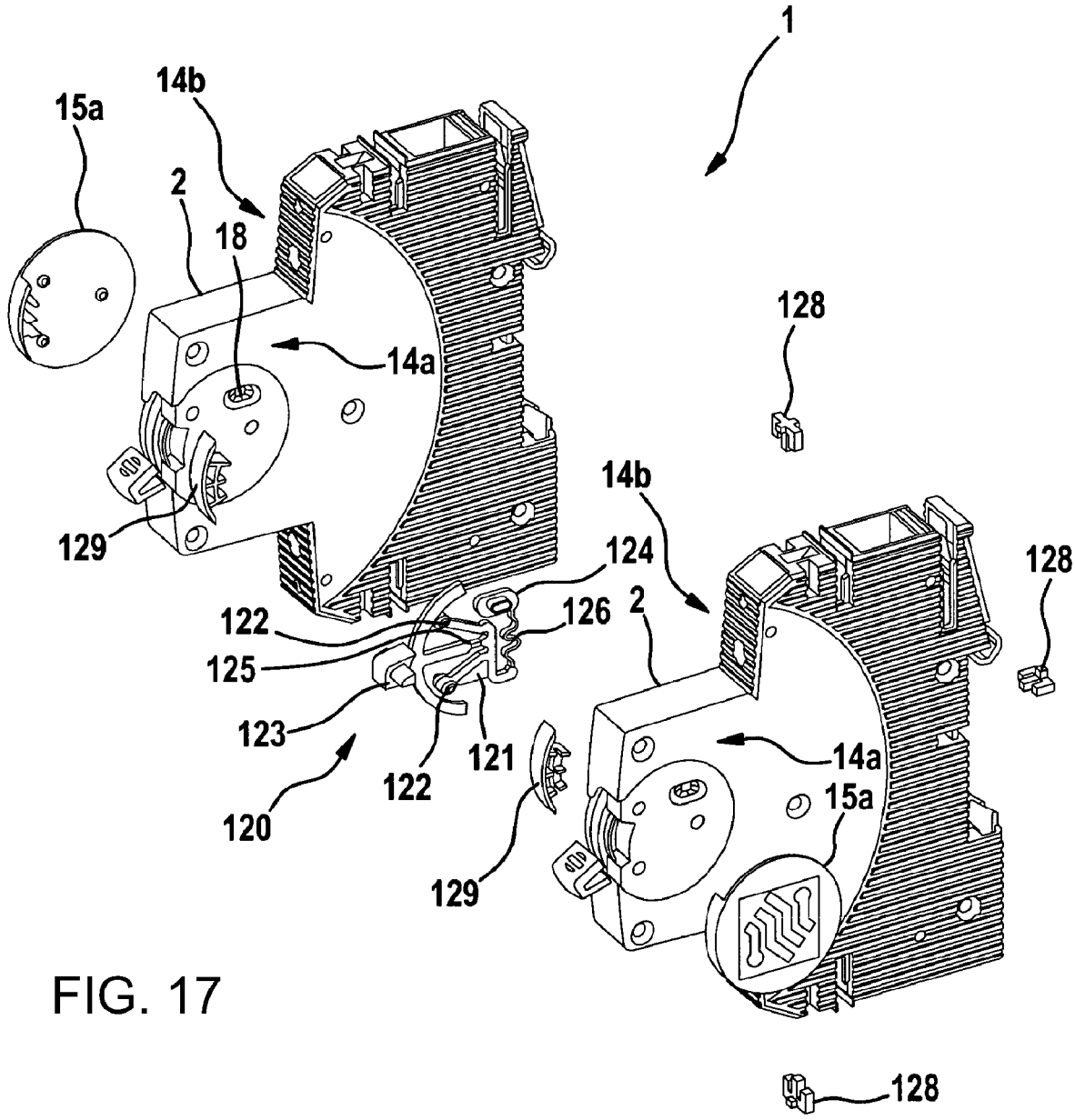
FIG. 17 is an exploded, perspective view of a two-pole embodiment of the protection switch with two protection switch modules according to FIG. 2.
Figure 18:
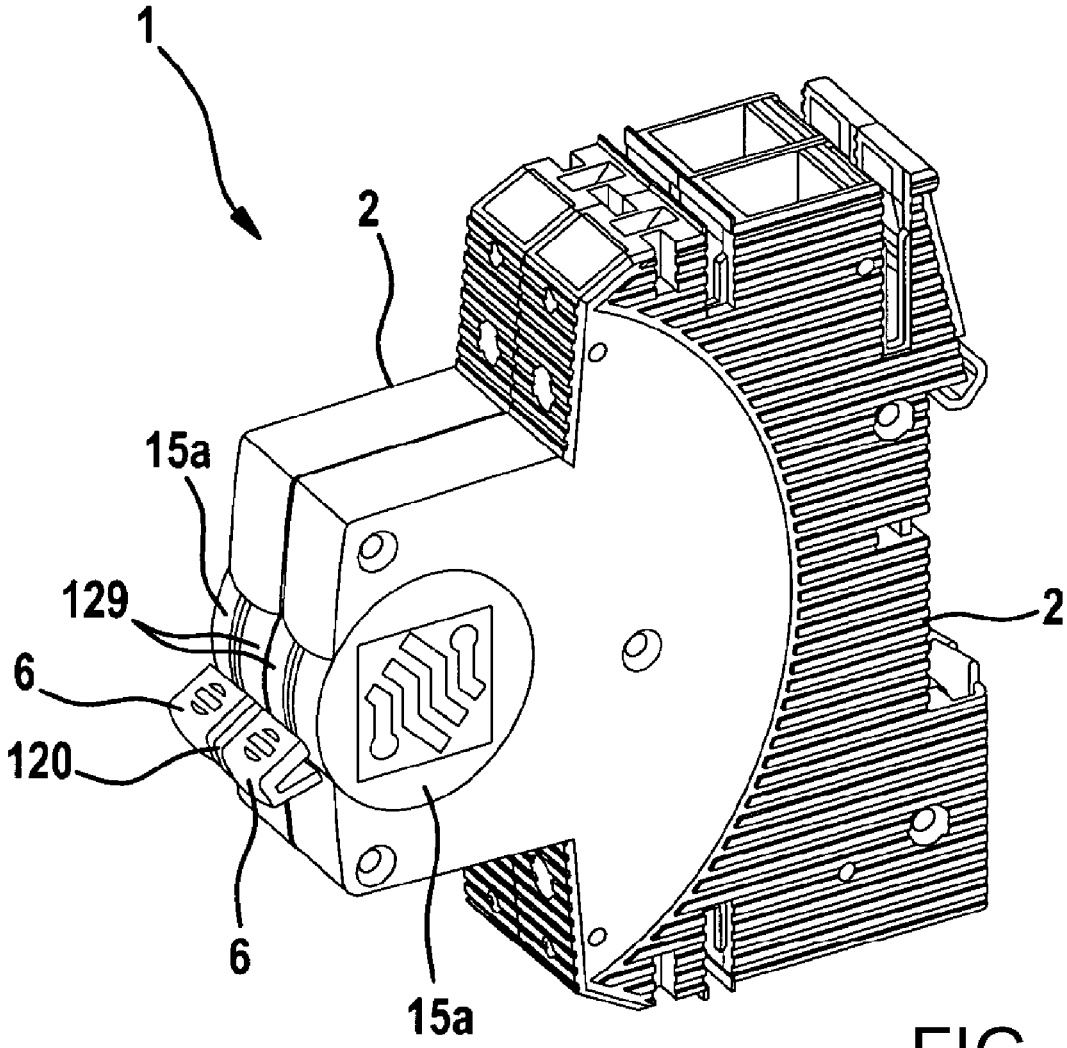
FIG. 18 is a perspective view of the protection switch according to FIG. 17 in the assembled state.

FIGS. 17 and 18 show two protection switch modules 2 of the type described above which are assembled to form a two-pole construction of the protection switch 1 at the end face. A coupling piece 120 is inserted between the two protection switch modules 2 in this configuration. The coupling piece 120 includes a body 121 which has two fixing projections 122 each. The fixing projections 122 can be snapped into corresponding receptacles 17 at the respective adjoining end faces 14*a* and 14*b* of the adjoining protection switch module 2 in each case so that the abutting protection switch modules 2 are also mechanically fixed to one another through the coupling piece 120.

A handling coupling 123 is molded on this body 121, on one hand, and a release coupling 124 is molded on, on the other hand. The handling coupling 123 is molded pivotably on the body 121 through a film hinge 125 and, in an assembly state shown in FIG. 18, engages the handles 6 of the adjoining protection switch modules 2 on both sides so that the pivoted levers 7 of these protection switch modules 2 are coupled to one another in an always flush pivoted position. The trip coupling 124 is flexibly molded onto the body 121 through a spring arm 126 bent in meander form and, in the assembled state, accesses a coupling projection 127 (FIGS. 8 to 10) of the trip slider 53 of the respective protection switch module 2 on both sides through the contact opening 18 of the respective adjoining housing wall. As a result, the trip sliders 53 of both protection switch modules 2 are coupled in such a manner that the tripping of a protection switch module 2 also trips the other protection switch module 2 in each case.

Through the use of a one-piece component, both mechanical fixing of the protection switch module 2 and dynamic coupling both of the manual operating mechanism 42 and of the trip mechanism 44 of both protection switch modules 2 is thus achieved by the coupling piece 120.

In order to reinforce the mechanical fixing, the protection switch modules 2 are additionally connected to one another by clamps 128 at the side faces 22*a*, 22*b* and the rear 8.

The respective outside end faces 14*a*, 14*b* of the protection switch modules 2 are covered by a dummy lid 15*a* (and 15*b*, respectively) in each case. Further front covers 129, which close off the area of the front 4, are disposed in each case around the pivoted lever 7 between the protection switch modules 2.

Figure 19:
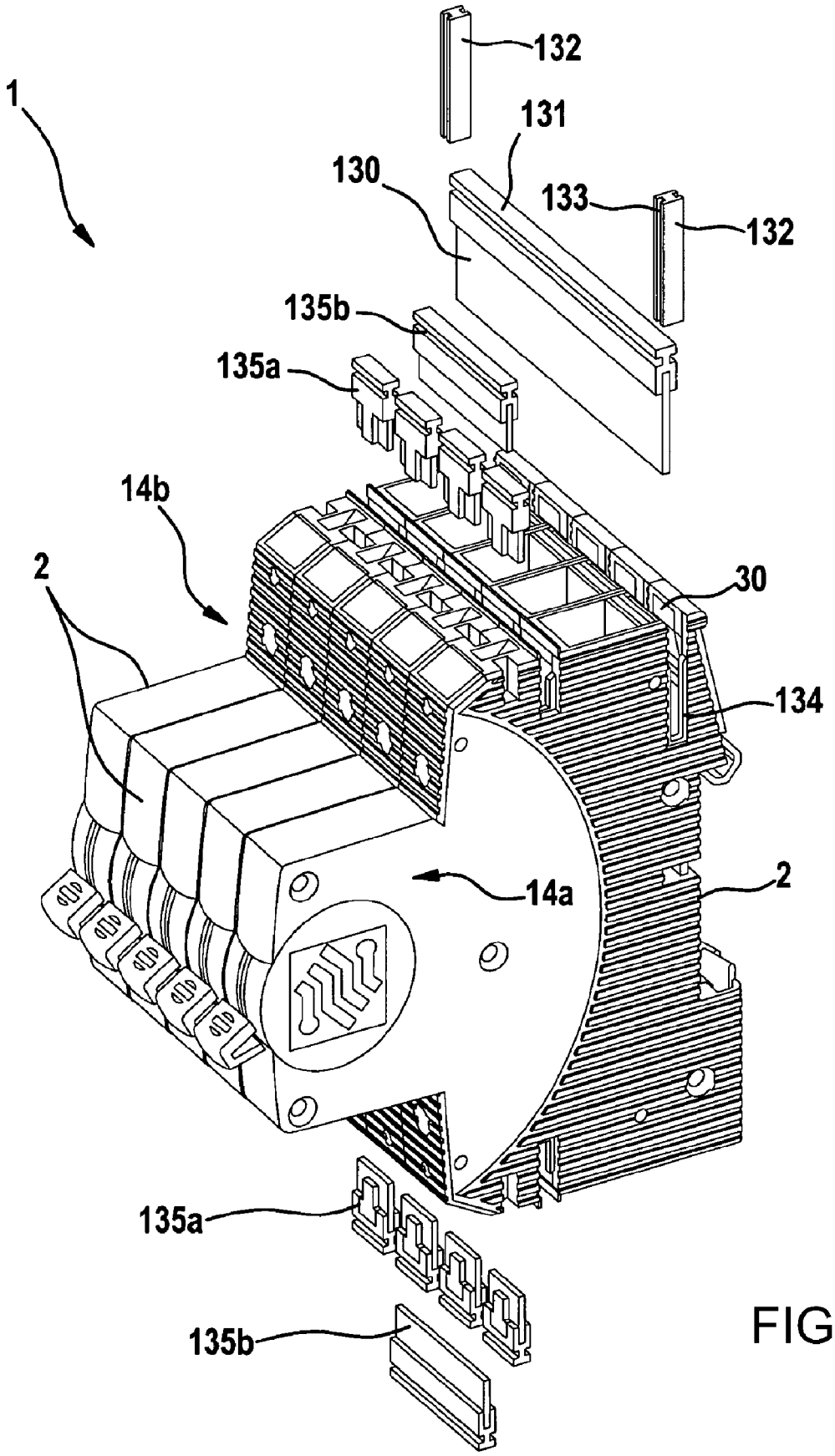
Figure 20:
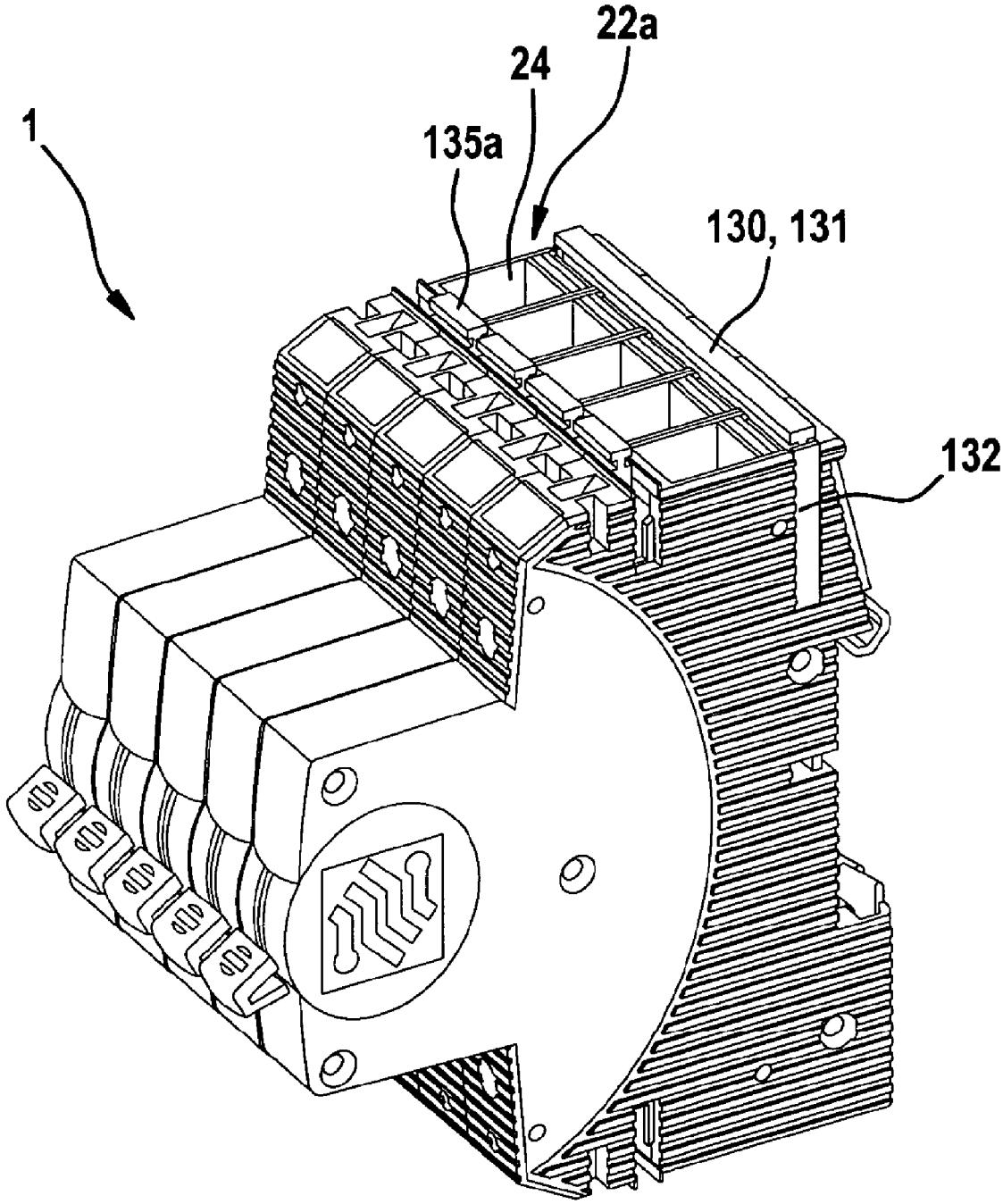
Figure 21:
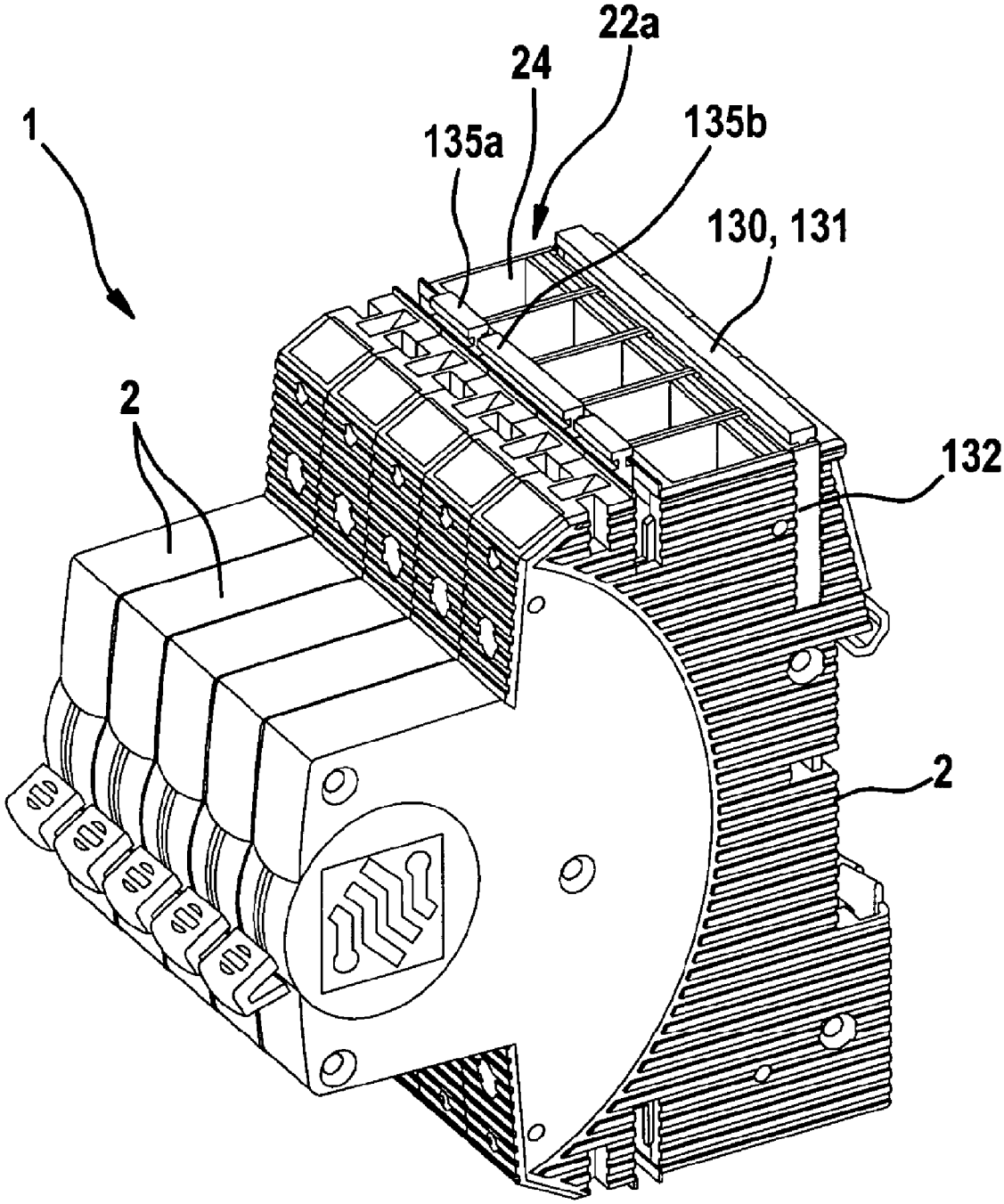

FIGS. 19 to 21 show a five-pole construction of the protection switch 1 in which the latter is interconnected in the manner of a current distributor. In the case of a current distributor, a common current supply is normally provided from which branch lines are branched off to supply a number of load circuits corresponding to the number of poles, through a separate protection switch module 2 in each case.

As a rule, dynamic coupling of the individual protection switch modules 2 is not required in the case of a current distributor. According to FIG. 19, the protection switch modules 2 are therefore placed together without interposed coupling pieces 120 (in contrast to the embodiment of the protection switch 1 described above). In order to provide a common supply to all protection switch modules 2, a current rail 130 which, as profiled part, substantially extends over the entire width of the joined protection switch modules 2, is pushed into the flush housing slots 30 so that the coupling contacts 29 of the protection switch modules 2 are short circuited through the current rail 130. As intended, the protection switch modules 2 are connected to an external supply line through the supply connection 24 of a protection switch module 2.

The current rail 130 is provided with a back cover 131 of insulating material. In the inserted state, only this back cover 131 protrudes at the side face 22*a* and closes off the housing slot 30 towards this side face 22*a* in a contact-proof manner (FIGS. 20, 21). The current rail 130 is covered towards the outside end faces 14*a*, 14*b* of the protection switch modules 2 by closing strips 132.

Each closing strip 132 is provided with a guide groove 133 running around its edge. The closing strip 132 is pushed with this guide groove 133 onto the guide strip 134 which runs around the edge of the housing slot 30 on each end face 14*a*, 14*b*. One closing strip 132 each is preferably molded onto the rear 8 of the housing 3 of each protection switch module 2 through a predetermined breaking point so that it can be broken off if necessary and pushed into the housing slot 30.

In FIGS. 19 to 21, current rail pieces 135*a* and 135*b* are also shown which can be pushed into the housing slots 32*a* or 32*b* in the same manner as the current rail 130, in order to couple the coupling contacts 31*a*, 31*b* of the signal connections 28*a*, 28*b*. FIGS. 19 to 21 show a first type of the current rail pieces 135*a* which in each case only short circuits the coupling contacts 31*a* or 31*b* of two immediately adjacent protection switch modules 2. A further type of current rail pieces 135*b*, shown in FIGS. 19 and 21, is formed of profiled material and can be cut into lengths as desired (analogously to the current rail 130) in order to short circuit an arbitrary number of coupling contacts 31*a* or 31*b*.

The current rail pieces 135*a* and 135*b* can be used alternatively or in any combination in order to interconnect the signal circuits of the protection switch modules 2 with one another.

The invention claimed is:

1. A protection switch, comprising:

at least one single-pole protection switch module including:

a housing;

a switching arm;

a fixed contact;

a moving contact carried by said switching arm and being pivotably movable against said fixed contact between a closed position and an open position;

a manual operating mechanism for manually adjusting said switching arm between said closed position and said open position;

a tripping mechanism for automatically resetting said switching arm into said open position upon occurrence of a tripping condition, said tripping mechanism having a trip slider;

a short-circuit trip device having a magnetic coil, a magnetic yoke and a magnetic armature connected with a plunger for advancing said trip slider;

a quenching device for quenching a switching arc, said quenching device having a quenching chamber with first and second side walls and an inlet and an outlet for the arc;

a first running rail connecting said fixed contact with said first side wall of said quenching chamber, said first running rail being disposed integrally with said magnetic yoke;

a stopping surface at which said moving contact rests in said open position of said switching arm;

a second running rail connecting said stopping surface with said second side wall of said quenching chamber; and a separation strip extending substantially from side wall to side wall of said quenching chamber, being molded onto said outlet of said quenching chamber and damming up said outlet of said quenching chamber by about 35% to 50% as compared with said inlet.

2. The protection switch according to claim 1, which further comprises a current supply contacted by said second running rail at a point of contact located behind said stopping surface for said switching arm at said second running rail, as seen from said moving contact along said switching arm.

3. The protection switch according to claim 2, wherein said second running rail is cut free from a center of said current supply and bent out in a manner of a lug.

4. The protection switch according to claim 1, wherein said outlet of said quenching chamber is dammed up by about 40% to 45%, as compared with said inlet.

5. The protection switch according to claim 4, wherein said outlet of said quenching chamber is dammed up by about 42%, as compared with said inlet.

6. The protection switch according to claim 1, which further comprises at least one guide plate disposed at said outlet of said quenching chamber for deflecting a gas flow leaving said quenching chamber.

7. The protection switch according to claim 6, wherein said at least one guide plate is integrally molded onto said housing.

8. The protection switch according to claim 1, which further comprises at least one cover plate, and a pressure compensating duct formed between said at least one cover plate and said housing, said housing having end faces, and said running rails forming an arc running space therebetween being limited by said at least one cover plate towards at least one of said housing end faces.

9. The protection switch according to claim 8, wherein said at least one cover plate is configured to cause said pressure compensating duct limited by said at least one cover plate to be open towards said inlet of said quenching chamber and towards an end of said arc running space facing said contacts.

10. The protection switch according to claim 1, wherein said magnetic yoke is interrupted by a gap in an area adjoining said outlet of said quenching chamber.

11. The protection switch according to claim 1, wherein said first running rail and said magnetic yoke are formed in one piece.

* * * * *